US007992974B2

(12) United States Patent
Matsuda et al.

(10) Patent No.: US 7,992,974 B2
(45) Date of Patent: Aug. 9, 2011

(54) INKJET RECORDING APPARATUS

(75) Inventors: Tadayuki Matsuda, Hitachi (JP); Mitsuo Igari, Kitaibaraki (JP); Akira Miyao, Hitachi (JP); Seiji Fujikura, Toukai (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 803 days.

(21) Appl. No.: 12/079,668

(22) Filed: Mar. 28, 2008

(65) Prior Publication Data

US 2009/0189960 A1 Jul. 30, 2009

(30) Foreign Application Priority Data

Jan. 28, 2008 (JP) ..... 2008-015747

(51) Int. Cl.
*B41J 2/09* (2006.01)
*B41J 2/14* (2006.01)

(52) U.S. Cl. ..... 347/77; 347/47

(58) Field of Classification Search ..... 347/77, 347/72–76, 78–79, 80–82, 47
See application file for complete search history.

(56) References Cited

U.S. PATENT DOCUMENTS 6,511,156 B1 * 1/2003 Kazama et al. ..... 347/47
7,506,951 B2 * 3/2009 Nishihara ..... 347/76
2005/0057608 A1 * 3/2005 Kachi ..... 347/45
2007/0019033 A1 * 1/2007 Sim et al. ..... 347/47
2008/0158297 A1 * 7/2008 Cha et al. ..... 347/47

FOREIGN PATENT DOCUMENTS

| | | |
|---|---|---|
| JP | 09-123461 | 5/1997 |
| JP | 10-296997 | 11/1998 |
| JP | 2001-138544 | 5/2001 |
| JP | 2001-191516 | 7/2001 |
| JP | 2002-067298 | 3/2002 |

* cited by examiner

*Primary Examiner* — K. Feggins

(74) *Attorney, Agent, or Firm* — Kilpatrick Townsend & Stockton LLP

(57) ABSTRACT

An inkjet recording apparatus includes a main body and a print head. The main body includes a mechanical portion and a control portion. The mechanical portion includes a pump that pressurizes or draws a liquid(s), such as an ink and/or a solvent, and a solenoid valve that switches between flow channels guiding the liquid to flow therethrough. The control portion controls respective operations including printing and running and stopping of the inkjet recording apparatus. The print head includes a nozzle that atomizes the ink pressure fed from the main body into ink droplets, a charging electrode that electrically charges the ink droplets, a deflecting electrode that forms an electric field that deflects the charged ink droplets, and a gutter that collects the ink unused for printing. The nozzle includes a surface-treated layer that repels the ink to a portion where the ink is supplied.

17 Claims, 14 Drawing Sheets

A-A CROSS SECTION

INKJET RECORDING APPARATUS

CROSS-REFERENCES TO RELATED APPLICATIONS

The present application claims priority from Japanese application JP2008-015747 filed on Jun. 28, 2008, the content of which is hereby fully incorporated by reference into this application for all purposes.

BACKGROUND OF THE INVENTION (1) Field of the Invention

The present invention relates to an inkjet recording apparatus.

(2) Description of the Related Art

Conventional continuous inkjet recording apparatuses that are generally known in the art are provided with nozzles whose surfaces are not specifically treated to be water or oil repellant. However, an inkjet recording apparatus, such as the apparatus disclosed in Japanese Unexamined Patent Application Publication No. 10-296997, includes a nozzle component which is a peripheral portion of an ink injection port of an orifice to which a water repellent treatment is applied.

The nozzle of the continuous inkjet recording apparatus further includes an ink supply flow channel that supplies ink to a liquid chamber in which the ink is temporarily accumulated, and an ink discharge flow channel through which the ink accumulated in the liquid chamber is drawn in the event that the apparatus is stopped. A part of the liquid chamber is formed as an exciting wall that provides the vibration necessary for atomization of the ink ejected from the nozzle.

In the technique disclosed in Japanese Unexamined Patent Application Publication No. 2002-67298, the ink supply flow channel and the ink discharge flow channel are disposed in such a manner as to bypass the exciting wall's vibratory wall and an exciting source causing vibration in the exciting wall.

Further, as shown in FIGS. 19 and 20 of Japanese Unexamined Patent Application Publication No. 2002-67298, in the nozzle conventionally used in the continuous inkjet recording apparatus, a nozzle body 300 includes a joint 301. A tube 302 through which the ink is pressure-fed from a body (not shown) and a joint 301 are connected together to thereby configure an ink supply channel.

Adjustment of the position of an ejecting ink stream 303, that is, adjustment of a nozzle central axis, is carried out by shifting with adjusting screws 306 and 307, along the directions of arrows A308 and A309, the positions of a housing 304 of the nozzle and a base 305 supporting the housing 304.

An exciting unit 310 for controlling vibration is isolated from and independent of, for example, the ink supply channel and the housing 304, so that the positional adjustment for the ink stream 303 does not influence the exciting unit 310.

In a known nozzle shown in FIG. 21, a flow channel 233 is configured along a central axis of a nozzle body 231, and miniaturization is implemented, in contrast with the nozzle shown in FIG. 19. In the configuration, an end portion of an axis 236 of a nozzle body 231 that is a part of an exciting unit 249 is formed as a joint portion 237 for connecting the ink supply channel, to thereby connect a tube 320.

Generally, in the nozzle of a continuous inkjet recording apparatus, such as disclosed in Japanese Unexamined Patent Application Publication No. 2001-191516, the bore of a nut with a screw-cut configuration is generally used for securing a vibration source. As such, no clearance is formed between the bore and a vibration source mounting axis, and also the outer portion of the nut has no stepped portion.

BRIEF SUMMARY OF THE INVENTION

In many cases, a continuous inkjet recording apparatus, such as shown in Japanese Unexamined Patent Application Publication No. 10-296997, is used for printing in a high speed production line, in which case the printed material is transferred to a subsequent processing step within a short time after being printed.

Accordingly, there are cases in which external forces are applied on a printed surface; for example, the printed surface can be accidentally contacted by a hand when the printed material is picked up, or a washing liquid is applied on the printed surface for washing immediately after printing.

Therefore, to prevent defacement of the printed image due to such external forces, the ink has to dry quickly after printing. Consequently, inks having high dryability (fast-drying properties) are used.

During a normal operation of the inkjet recording apparatus, ink typically does not remain in the nozzle long enough to dry since the ink is continuously ejected from the ink ejection port of the nozzle. However, during non-printing idle periods any ink remaining in the nozzle dries and fixes, thereby causing clogging of the ink ejection port.

When clogging of the ink ejection port has occurred, undesired problems can take place. For example, the ink may be blocked from being ejected even when the interior of the nozzle is pressurized or the ink ejection direction may be deflected and may continue to be deflected even when the ink is ejected. When such a problem occurs, this leads to situations in which not only normal printing becomes impossible, but also the production line can be contaminated with ink.

As such, the ink in the ink ejection port has to be removed when stopping ink ejection from the ink ejection state; or alternatively even when the ink remains as it is, the ink in the ink ejection port has to be prevented from drying.

One method for removing the ink in the ejection port is, for example, to clean the ink ejection port with a washing liquid or to completely draw the ink without use of the washing liquid.

When the ink ejection port is cleaned with the washing liquid, the used washing liquid finally flows into an ink container. As such, when a large amount of the washing liquid is used relative to the amount of capacity in the ink container, physical properties of the ink can temporarily change resulting in irregular printing.

Further, the use of a large amount of washing liquid leads to an increase of running costs, so that cleaning of the ink ejection port with a minimized amount of the washing liquid arises as a challenge to be solved.

The nozzle of the Japanese Unexamined Patent Application Publication No. 2002-67298 includes an ink supply flow channel and an ink discharge flow channel. The respective flow channels are complex flow channels formed via a plurality of components and bypass an exciting wall.

The configuration is thus formed with the ink flow channel bypassing the exciting wall as shown in the nozzle structure disclosed in Japanese Unexamined Patent Application Publication No. 10-296997. The nozzle structure disclosed in Publication No. 10-296997 is formed such that a plate-shaped component used for forming the exciting wall is supported with two components via seal components, and a vibratory area size of the exciting wall is determined that is large enough to efficiently vibrate or excite the ink in the liquid chamber.

Further, the ink supply flow channel and the ink discharge flow channel, respectively, require nozzle joints for being coupled to tubes connected between the body of the inkjet recording apparatus and an ink head having the nozzle thereon. The nozzle structure described above provides for the nozzle joints coupled to the nozzle and other components.

As described above, in the nozzle disclosed in Japanese Unexamined Patent Application Publication No. 10-296997, a large number of components are necessary, so that individual variations among nozzles in assembly are likely to occur. One problem caused by such variations among nozzles is that the resonant frequency of a nozzle is varied. A large variation in the nozzle resonant frequency may cause inefficient exciting unit activation. Further, adjustment of the activation frequency of the exciting unit may wastefully consume time.

Further, an increased number of components make it difficult to implement the reduction in nozzle dimensions for the convenience of assembly and processes.

In the case of the compact nozzle shown in FIG. 21, the influence of the reaction force on the exciting unit varies depending on the manner of routing the tube 320. Further, when, as in the similar case of the nozzle shown in FIG. 19, the position of an ejecting ink stream is adjusted by moving a housing 121, the joint portion 237 is simultaneously moved, so that there is a possibility that the reaction force of the tube 320 is varied. When external forces are received by the exciting unit, an undesirable form of vibration is imparted to the ink, which influences the ejected ink droplet shape or profile, in a manner leading to irregular printing. Therefore, the problem consequently arises that the proper operation of the structure that permits the exciting unit to receive external forces depends on the adjustment of the stream position.

In the invention disclosed in Japanese Unexamined Patent Application Publication No. 2001-191516, in order to reduce the resonant frequency of the body of the nozzle in which the vibration source is clamped between the vibration source mounting axis and the vibration source securing nut, the mass of the body of the nozzle must be increased by increasing the outside diameter and length of the vibration source securing nut. Consequently, the body of the nozzle is enlarged.

As a consequence, miniaturization of the print head on which the body of the nozzle is mounted is hindered.

One object of the present invention is to provide an inkjet recording apparatus that enables nozzle cleaning with a minimized amount of solvent.

Another object of the present invention is to provide an inkjet recording apparatus includes a simplified structure for liquid flow channels in a nozzle.

Another object of the present invention is to provide a user with an inkjet recording apparatus enabling implementing stable printing.

Another object of the present invention is to provide an inkjet recording apparatus that includes a print head miniaturized in association with a miniaturized nozzle body, to thereby enable the apparatus to be flexibly compilable with various space requirements in the event of installation into a customer's facility.

In order to achieve the objects described above, according to one configuration of the present invention, an inkjet recording apparatus is provided that includes a main body including a mechanical portion and a control portion, the mechanical portion including a pump that pressurizes or draws a liquid(s) such as an ink and/or a solvent, and a solenoid valve that switches between flow channels guiding the flow of liquid therethrough, and a control portion controlling respective operations including printing and running and stopping of the inkjet recording apparatus; and a print head including a nozzle that atomizes the ink pressure-fed from the main body into ink droplets, a charging electrode that electrically charges the ink droplets, a deflecting electrode that forms an electric field that deflects the charged ink droplets, and a gutter that collects unused ink for subsequent printing. The nozzle includes a surface-treated layer that repels the ink to a portion where the ink is supplied.

Further, according to another configuration, an inkjet recording apparatus is provided that includes a main body that supplies an ink; and a print head including a nozzle that ejects the ink transferred from the main body through a pipeline, the nozzle including an ejection port that ejects the ink, a liquid chamber including an inflow port allowing the ink to flow thereinto and an outflow port communicating with the ejection port, a liquid supply flow channel that guides the ink into the liquid chamber by connecting between the pipeline through which the ink is transferred from the main body and the inflow port, an exciting wall that is provided in a part of the liquid chamber and that vibrates the ink present in the liquid chamber, and an exciting portion that vibrates the exciting wall. The inflow port of the liquid chamber is provided in the exciting wall.

Further, according to another example configuration of the present invention, an inkjet recording apparatus is provided that includes a nozzle that vibrates and ejects an ink supplied from an ink container provided in an interior of a main body; a charging electrode that electrically charges ink droplets ejected from the nozzle; a deflecting electrode that forms an electric field that deflects the charged ink droplets; and a housing that includes a structure that holds the nozzle by using an elastic member, and a joint portion that connects to an ink supply flow channel that guides the ink supplied from the ink container to flow therethrough. The nozzle and the joint portion are not in direct contact with each another.

Further, another configuration of the present invention provides an inkjet recording apparatus that forms a character by using a nozzle that injects ink droplets, a charging electrode that electrically charges ink droplets ejected from a nozzle with a character signal and a deflecting electrode that deflects the charged ink droplets, and that collects for reuse ink droplets unused for forming the character. The nozzle includes a vibration source mounting axis and a nut that secures a cylindrical vibration source fitted about the vibration source mounting axis, wherein a bore of the nut is formed into a stepped shape, and a clearance is provided between the vibration source mounting axis and a part of the bore of the nut.

According to the present invention, for example, an inkjet recording apparatus that enables nozzle cleaning even with a small amount of solvent can be realized.

Further, according to the present invention, for example, nozzle liquid flow channels in a nozzle of an inkjet recording apparatus can be simplified.

Further, according to the present invention, for example, an inkjet recording apparatus capable of performing stable printing can be provided.

Further, according to the present invention, for example, miniaturization of a nozzle and miniaturization of a power supply can be accomplished by giving a bore and outer profile of a vibration source securing nut stepped configurations.

BRIEF DESCRIPTION OF THE DRAWINGS

These and other features, objects and advantages of the present invention will become more apparent from the following description when taken in conjunction with the accompanying drawings, in which.

DETAILED DESCRIPTION OF THE INVENTION

Figure 1:
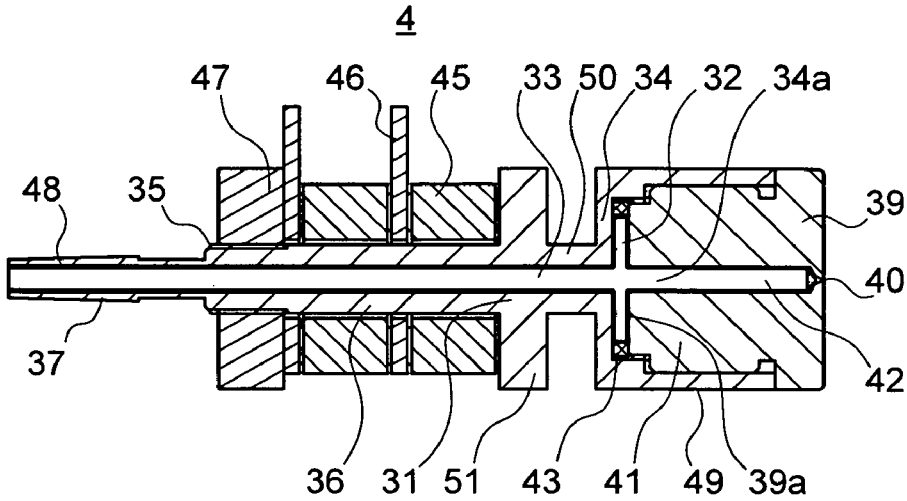
FIG. 1 is a cross sectional view of a nozzle according to a first embodiment of the present invention.

Embodiments of the present invention will be described below with reference to specific examples shown in the accompanying drawings. However, it is to be understood that the scope of the present invention is not limited to the described embodiments and that the drawings are to be regarded in an illustrative rather than a restrictive sense.

First Embodiment

A first embodiment will be described below with reference to FIGS. 1 to 3. FIG. 2 shows an exterior view of an inkjet recording apparatus according to the first embodiment of the present invention.

The inkjet recording apparatus according to the present embodiment is a so-called continuous inkjet recording apparatus that performs printing by ejecting ink from a nozzle and that collects the ejected ink in a non-printing event (i.e., when there is no printing activity). The inkjet recording apparatus shown in FIG. 2 has a configuration that includes a main body 600 containing a control system and a circulation system, a print head 610 including a nozzle that produces ejection ink droplets, and a print head cable 620 that fluidically connects (the term "fluidically" for connection or coupling, hereinbelow, will be omitted inasmuch as it is apparent from the drawings) between the main body 600 and the circulation system and control system of the print head 610.

The main body 600 includes a touchpanel-type liquid crystal panel 630 that permits a user to input, for example, print contents and print specifications and that is capable of displaying, for example, control contents and apparatus operation status. The print head 610 is covered with a stainless steel cover. The interior of the cover houses the nozzle, which will be described further below, and electrodes and the like that control flow or dispersion (hereinafter, "dispersion") of ink droplets. An opening 615 is provided in one end face of the cover through which ink droplets can travel for use in printing.

Figure 3:
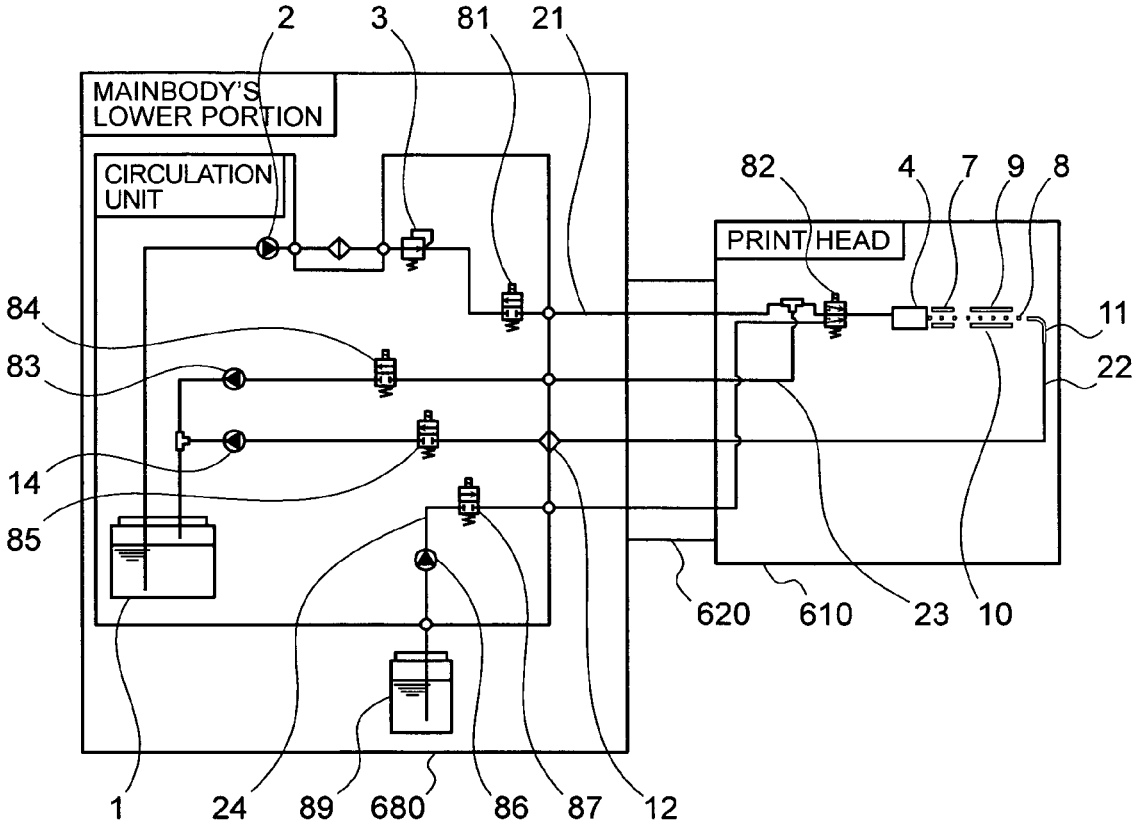
FIG. 3 is a simplified view of an ink circulation channel system of the inkjet recording apparatus according to the first embodiment.

FIG. 3 is a simplified view of an ink circulation channel system of the inkjet recording apparatus according to the one embodiment of the present invention.

The ink circulation channel system includes, as ink circulation channels, an ink supply flow channel 21, an ink collection flow channel 22, an ink draw-in flow channel 23, and a solvent supply flow channel 24. The ink supply flow channel 21 supplies ink, solvent, and the like to the print head 610 through a pipeline provided in the interior of a cable 620. The ink collection flow channel 22 returns ink, solvent, and the like to circulation system control components provided in a mainbody's lower portion 680 (a lower portion of the main body 600) from the print head 610. The ink draw-in flow channel 23 draws ink from the interior of a nozzle 4 when the apparatus is stopped. The solvent supply flow channel 24 supplies a solvent that cleans the interior of the nozzle 4 when the apparatus is stopped.

The circulation system control components of the lower portion of the main body 600 (i.e., the mainbody's lower portion 680) and disposed in respective flow channels will be described below.

First, the circulation system control components, which are disposed in the mainbody's lower portion 680, include components that are disposed in the ink supply flow channel 21 and that supply ink to the nozzle 4. The components include an ink container 1 in which ink is stored, an ink supply pump 2 that draws ink from the ink container 1 and pressure-feeds the ink, a pressure regulating valve 3 that regulates an ink pressure, and an ink supply solenoid valve 81 that performs the opening/closing functions of an ink supply flow channel.

Further, components related to the ink collection flow channel 22 and for collecting ink from a gutter 11 provided in the print head 610 includes a filter 12, a collection solenoid valve 85, and a collection pump 14. The filter 12 is disposed in the mainbody's lower portion 680, the collection solenoid valve 85 performs the opening/closing functions of an ink collection flow channel, and the collection pump 14 returns ink droplets 8 that have not been used in printing.

Components related to the ink draw-in flow channel 23 that draws ink from the nozzle 4 include a suction pomp 83 and a draw-in solenoid valve 84. The suction pomp 83 draws ink staying in the nozzle 4 after the apparatus is stopped. The draw-in solenoid valve 84 performs the opening/closing functions of an ink draw-in flow channel.

Components related to the solvent supply flow channel 24 that supplies the solvent to the nozzle 4 include a solvent supply pump 86 and a solvent solenoid valve 87. The solvent supply pump 86 pressure-feeds the solvent, which performs nozzle cleaning when the apparatus stops, from the solvent supply pump 89 to the nozzle 4. The solvent solenoid valve 87 opens or closes a solvent supply flow channel.

Operation of the circulation system of the inkjet recording apparatus according to the present embodiment will be described below.

During the printing process, ink circulates through the ink supply flow channel and the ink collection flow channel. When the ink supply pump 2 starts operation and the ink supply solenoid valve 81 is opened, ink is drawn from the ink container 1. The ink drawn from the ink container 1 is then supplied to the print head 610 via the print head cable 620 after sequentially traveling through the pump 2, the pressure regulating valve 3, and the ink supply solenoid valve 81.

The ink supplied to the print head 610 is supplied to the nozzle 4 by way of a three-way valve 82 that changes between the supplied ink and solvent, and the ink is then ejected from the nozzle 4.

The ink is thus ejected in the form of droplets. The ink droplets 8 are deflected in the dispersion direction in an electric field formed between an upper deflecting electrode 9 and a lower deflecting electrode 10. The dispersion direction is thus changed corresponding to the charge amount applied by charging electrode 7. The ink droplets 8 in the changed dispersion direction are dispersed from the opening 615 of the print head 610 toward a printing material (not shown).

A recording signal source is coupled to the charging electrode 7. When a recording signal voltage is applied to the charging electrode 7, the ink droplets 8 continuously ejected from an ejection port 40 are charged. The upper deflecting electrode 9 is coupled to a high voltage power supply, and the lower deflecting electrode 10 is grounded. An electric field is thereby formed between the upper deflecting electrode 9 and the lower deflecting electrode 10. The charged ink droplets 8 are dispersed by being deflected corresponding to the amount of charge they receive, and then adhere on a recording medium, and thus printing is performed.

Ink droplets 8 not charged with an amount of electricity necessary for deflection are directed to disperse into the gutter 11. When the solenoid valve 85 is kept open, ink in the ink collection flow channel 22, through the operation of the collection pump 14, is returned to the ink container 1 via the filter 12. The inkjet recording apparatus is configured such that ink returned as described above is reused, ink necessary for printing is deflected and dispersed towards the recording medium from the print head 610, and ink not used in these operations is circulated within the apparatus.

Stopping the ejection of ink from the nozzle 4 when apparatus operation is halted will be described below. For purposes of print quality improvement, a variety of inks with high dryability (i.e., fast-drying properties) are used, as described above, and so the ink contains a surface active agent and a large variety of other additives. Therefore, when the ink remains on components including, for example, an orifice plate 41 and the nozzle 4, adhesion of the dried ink increases and introduces a clogged state that can disable printing.

To overcome the above problem, the ink supply solenoid valve 81 is turned to the closed state, the draw-in solenoid valve 84 is opened, and the ink remaining in the nozzle 4 is drawn with a suction pump 83 into the ink container 1. After the ink has been drawn from the nozzle 4, the solvent supply pump 86 is operated by opening the solvent solenoid valve 87. Simultaneously, the three-way valve 82 in the print head 610 on the side of the solvent supply flow channel 24 is opened, thereby supplying the solvent to the nozzle 4.

With the solvent thus supplied, the interior of the nozzle 4 is cleaned. During the cleaning process, the solvent ejected from the nozzle 4 is collected into the ink container 1 by operation of the collection pump 14 with the collection solenoid valve 85 opened.

Cleaning of the nozzle 4 is performed for a predetermined time period. When cleaning is determined to be completed, a solvent supply pump 86 is stopped by closing the solvent solenoid valve 87. In addition, the suction pump 83 is operated with the three-way valve 82 being switched and the draw-in solenoid valve 84 being opened. As a result of this operation, the solvent in the nozzle 4 is collected into the ink container 1.

As described above, when operation of the apparatus is halted, the interior of the nozzle 4 is cleaned with the solvent supplied to the nozzle 4, so that ink adherence in the nozzle 4 is prevented. Consequently, the inkjet recording apparatus is enabled to return to a predetermined optimum performance standard for resumed printing.

However, the problem of ink adherence in the nozzle 4 may not be entirely solved since, even when a cleaning process is provided when the operation of the apparatus is stopped, ink may still be considered to remain in the nozzle 4, for example, because of the structural nature of the ink channel system in the nozzle 4 and adhesivity of ink. Generally, an approach for increasing the cleaning time period and an approach for increasing the amount of the cleaning solvent are considered in order to remove such residual ink. However, either of these approaches results in an increased amount of the solvent returning to the ink container 1. This is a factor that changes, for example, the viscosity and concentration of ink, thereby making it necessary to adjust, for example, the viscosity and concentration of ink when again performing printing, consequently worsening ease of use or usability of the apparatus.

As such, the nozzle 4 according to the present invention was developed through research focused on eliminating deficiencies, such as degradation of the nozzle performance and degradation of the ink performance in the ink container 1, with the use of a minimum amount of the solvent. The nozzle 4 according to the present embodiment will be described in more detail with reference to FIG. 1.

Figure 2:
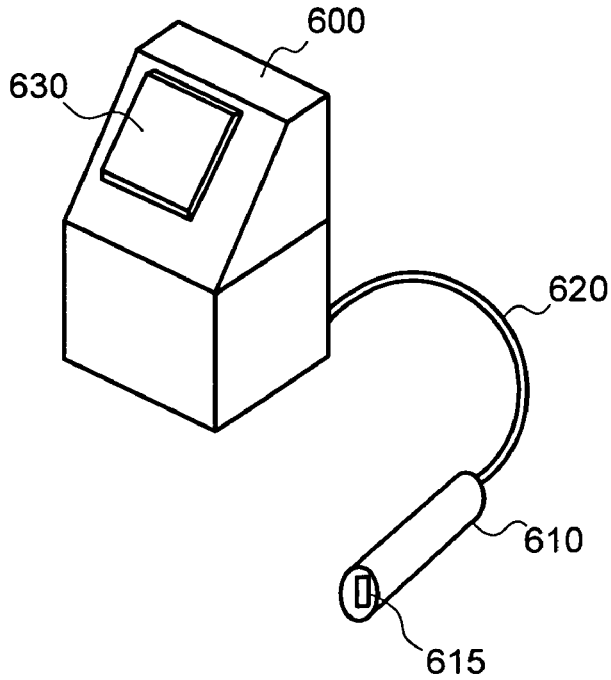
FIG. 2 is an exterior view of the inkjet recording apparatus according to the first embodiment.

The nozzle 4 shown in FIG. 1 includes an orifice 39 and a nozzle body 31. The orifice 39 includes an ink flow channel 42 including an ejection port 40 that ejects ink on a central axis. The nozzle body 31 includes a nozzle head 49 that threadably engages the orifice 39 through a screw thread portion 41 provided on an outer circumference portion of the ink flow channel 42.

The nozzle body 31 further includes a vibration source mounting axis 36, a vibration transferring portion 50, and a nozzle joint 37. The vibration source mounting axis 36 includes a plurality of cylindrical vibration sources 45 (to which electric power is supplied by power supply terminal 46) inserted into it, and is fixedly secured by a vibration source securing nut 47 (hereinafter, "nut") to a stopper portion 51. The vibration transferring portion 50 transfers vibration from the vibration source mounting axis 36 to an exciting wall 34 of the nozzle head 49. The nozzle joint 37 connects to the side opposite the vibration transferring portion 50 of the vibration source mounting axis 36. The nut 47 threadably engages with a vibration source securing external thread portion 35 (hereinafter, "external thread portion") provided on the vibration source mounting axis 36, and the mounting positions of the vibration sources 45 can be adjusted with the nut 47.

In the interiors of the nozzle joint 37, an ink flow channel 33 of the nozzle body 31 is provided that connects to a pipeline communicating with the three-way valve 82, the vibration source mounting axis 36, and the vibration transferring portion 50. The length of the ink flow channel 33 is designed to be a length that does not cause a liquid resonance due to the vibration of the vibration sources 45.

Coupled to the orifice 39, the nozzle head 49 forms an ink chamber 32 between the exciting wall 34 and an edge face 39*a* located opposite a face on which the ejection port 40 of the orifice 39 is provided. The ink chamber 32 includes an opening portion of the ink flow channel 42 of the orifice 39 and an opening portion of the ink flow channel 33 of the nozzle body 31. In order to prevent ink from flowing to other portions, a seal portion 43 such as, for example, an o-ring, is provided to be closely fastened on outer circumference portions of the edge face 39*a* of the orifice 39 and the exciting wall 34.

Ink flow in the nozzle 4 in the configuration described above will be described below. Ink supplied to the nozzle 4 is guided into the ink chamber 32 without the liquid resonance being caused by the ink flow channel 33 of the nozzle body 31. Vibration is imparted to ink stored in the ink chamber 32 through vibration of the exciting wall 34 transferred by way of the vibration transferring portion 50, causing ink to travel through the ink flow channel 39*a* of the orifice 39 to then be ejected from the ejection port 40. The ejected ink is atomized in the form of ink droplets 8 through mechanical resonance generated by the exciting wall 34 located in a position slightly apart from the ejection port 40.

In the nozzle body 31, according to the present embodiment, the exciting wall 34, the vibration source mounting axis 36, and the nozzle joint 37 are integrally configured in alignment. The ink flow channel 33 extends along the central axis of this configuration.

The method by which the cylindrical vibration sources 45, and the power supply terminals 46 that supply electric power for use for drive sources of the vibration sources 45 are assembled together will now be described. First, the vibration sources 45 and the power supply terminals 46 are sequentially passed along the vibration source mounting axis 36 towards the stopper portion 51, and then are secured through engagement of the vibration source securing nut 47 with the external thread portion 35.

The orifice 39 is assembled with the nozzle head 49 in the following manner. A seal 43 is disposed in contact with the exciting wall 34, and the screw thread portion 41 provided to the orifice 39 is engaged with an orifice mounting internal thread portion (not shown) provided on an inner wall of the nozzle head 49 of the nozzle body 31. Thereby, the orifice 39 is assembled with the nozzle head 49.

In the nozzle 4, according to the present embodiment, a surface-treated layer (film) 48 for repelling ink is provided on surface portions of the nozzle 4 where ink comes into contact. More specifically, the surface-treated layer 48 is composed of a high water repellent and oil repellent fluorocompound to which ink is less able to adhere. The surface-treated layer 48 is provided on various surface including an inner circumferential surface of the ink chamber 32, a portion of the ink flow channel 42 that includes an inner circumferential surface of the ink flow channel 33, and on the exciting wall 34, seal 43, and edge face 39*a* of the orifice 39 forming the inner circumferential surface of the ink chamber 32, and the ejection port 40. The surface-treated layer 48 must be ink repellent or at least water repellent. The surface-treated layer 48 is formed through chemical reaction.

In one experiment, when the ink was dropped on a surface of an orifice configured from an SUS material without a surface-treated layer, the contact angle between the surface of the orifice and the ink droplet was about 5 degrees. For purposes of comparison, the ink was dropped on a surface of an orifice having the surface-treated layer, resulting in a contact angle between a material surface and the ink droplet formed on the material surface that was in the range of from about 35 degrees to 39 degrees. These experiment results illustrate that the separability of ink is improved with the presence of the surface-treated layer.

In the case the surface of the seal 43 is a resin from which an action similar to that of the surface-treated layer 48 can be obtained, the surface-treated layer 48 does not have to be provided to the seal 43. Alternatively, the surface-treated layer 48 can be a film either having a high property in the water or oil repellency or having any one of the properties.

When the inkjet recording apparatus, according to the present embodiment, stops operation, the ink supply solenoid valve 81 in the ink supply flow channel 21 is closed in order to stop supply of ink to the nozzle 4. In addition, the draw-in solenoid valve 84 is opened, and residual ink in the nozzle 4 is collected into the ink container 1. Through these operations, the interiors of the flow channels of the nozzle body 31 and the orifice 39 are emptied. Since the surface-treated layer 48, which is formed of a fluorocompound and has water and oil repellency, is provided, the separability of ink from surfaces in the ink flow channels is improved and the ink can be efficiently collected into the ink container 1.

The solvent solenoid valve 87 is then opened and the solvent side of the three-way valve 82 is opened, whereby the solvent is supplied to the nozzle body 31, and the interior of the nozzle 4 is cleaned. During the cleaning process, the collection solenoid valve 85 is opened, and the collection pump 14 is activated, whereby the solvent ejected from the ejection port 40 is collected into the ink container 1.

In the structure of the nozzle 4 according to the present embodiment, it is preferable that the surface-treated layer 48 be provided at least to the ejection port 40 where the flow channel is narrowed, and to the surface constituting the ink chamber 32, where the flow channel is widened. If ejection port 40 is narrow, clogging is likely to occur because of dried ink adherence. Although the flow channel associated with the ink chamber 32 is wider than other flow channels, the solvent or washing or cleaning liquid may be less likely to circulate there. To solve the problems these flow channels may have with clogging due to adhering ink, the surface-treated layer 48 is provided at least to the ejection port 40 and the surface constituting the ink chamber 32. Therefore, when residual ink in the nozzle 4 is drawn in the ink cleaning process, the residual ink can be efficiently collected into the ink container 1, so that the amount of the solvent used in cleaning can be reduced.

Further, as described above, in the nozzle 4, according to the present embodiment, the surface-treated layer 48 can be provided at least for the surface of the ink chamber 32 where the flow channel is widened. Although the ejection port 40 is likely to be cleaned as the solvent passes there at high pressure, in the case of the ink chamber 32 where the cross sectional area size is larger than the cross sectional areas of other ink flow channels, the solvent is less likely to circulate into that ink chamber. Therefore, in this case, the surface-treated layer 48 is provided at least to the surface of the ink chamber 32. Thereby, when residual ink in the nozzle 4 is drawn in the ink cleaning process, the residual ink can be efficiently collected into the ink container 1, so that the amount of the solvent used in cleaning can be reduced.

As described above, the solvent is supplied to the nozzle body 31 when the apparatus is stopped, and residual ink in the nozzle 4 is efficiently collected into the ink container 1 before the interior of the nozzle 4 is cleaned. Therefore, the amount of the solvent for use in cleaning can be reduced. Consequently, an inkjet recording apparatus enabling nozzle cleaning with a minimized amount of solvent can be realized.

Due to a reduction in the amount of the solvent for use in cleaning, the amount of the solvent to be collected into the ink container 1 is also reduced. Therefore, variations in ink properties and ink dispersal during printing can be minimized, and hence the stability in print quality is improved. Further, an inkjet recording apparatus that features low running cost can be provided.

Second Embodiment

Figure 11:
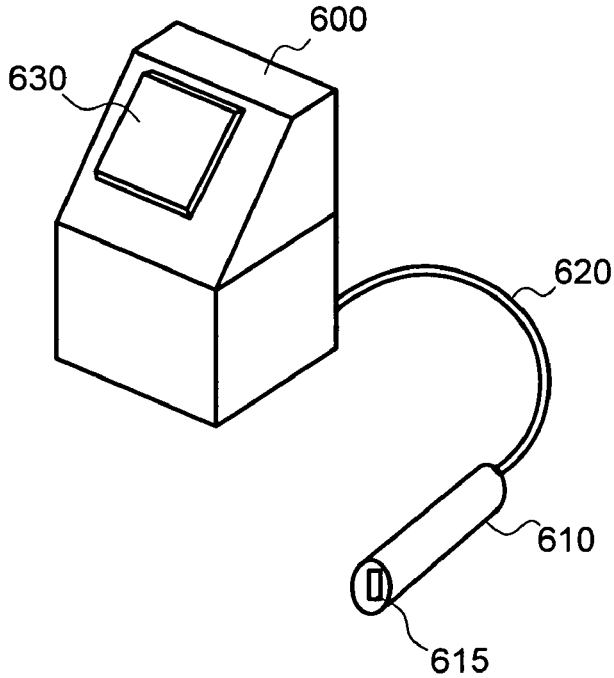
FIG. 11 is an exterior view of the inkjet recording apparatus according to the second embodiment.

A second embodiment will be described below with reference to the drawings. FIG. 11 shows an exterior view of an inkjet recording apparatus according to a second embodiment of the present invention.

The inkjet recording apparatus shown in FIG. 2 has a configuration including a main body 600, a print head 610, and a print head cable 620.

The main body 600 includes the configuration of a control system and the configuration of a circulation system. The control system controls the inkjet recording apparatus, and the circulation system includes a drive unit including components such as a pump and a solenoid valve that opens or closes a pipeline through which ink flows. The pumps described in greater detail below include, for example, a pump that pressurizes ink for the transfer of stored ink to the print head 610 and a pump that draws ink for collecting unused ink.

The print head cable 620 is connected with the main body 600 and the print head 610, and more specifically, is connected with the circulation and control systems of the print head 610. The print head cable 620 has incorporated within it, for example, necessary liquid flow channels, control lines, and power lines.

The main body 600 includes, on a front upper portion, a touchpanel-type liquid crystal panel 630 that permits the user to input, for example, print contents and print specifications and that is also capable of displaying, for example, control contents and apparatus operation status information.

The print head 610 is covered with a stainless steel cover. The interior of the cover houses a nozzle that injects ink droplets, as well as electrodes and the like that control dispersion of ink droplets. An opening 615 is an opening portion through which ink droplets for use in printing pass.

Figure 12:
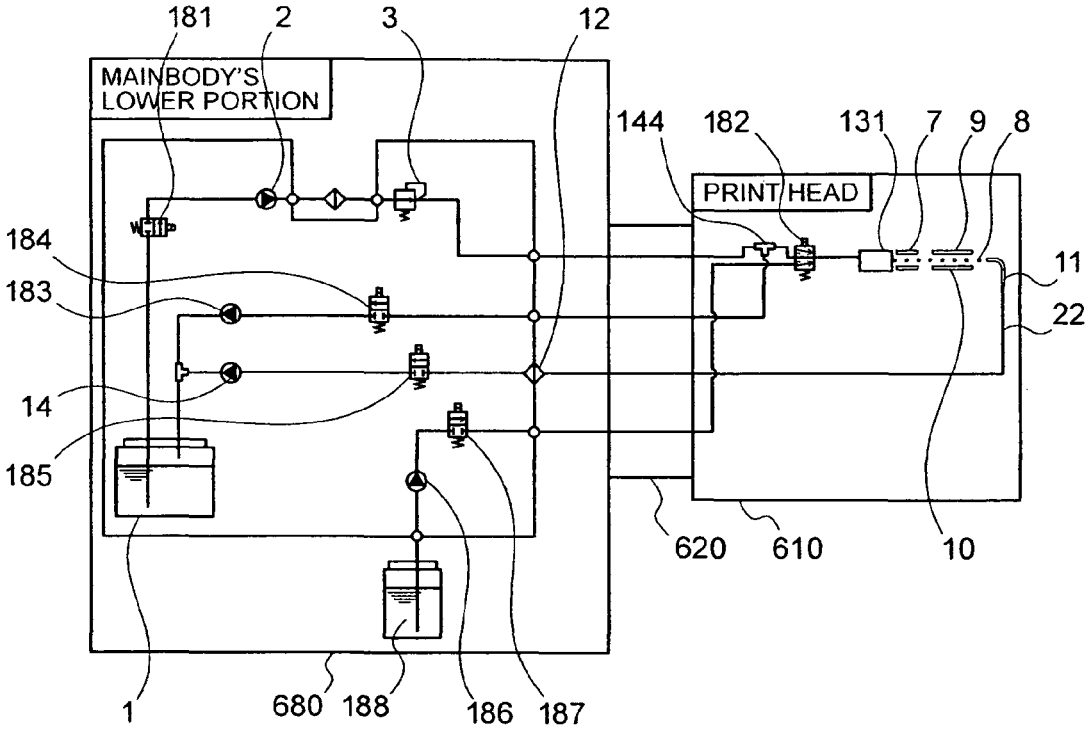
FIG. 12 is a schematic view of the inkjet recording apparatus of the second embodiment.

The configuration of the inkjet recording apparatus, which has been described with reference to FIG. 11, will now be described below with reference to FIG. 12. FIG. 12 is a simplified view of an ink circulation channel system.

A circulation unit (a portion surrounded by a single-dotted chain line), which is a component of the circulation system, is disposed in a main body's lower portion 680 of the main body 600. Fluid control components constituting the circulation unit include an ink container 101, an ink supply solenoid valve 181, an ink pump 102, a pressure regulating valve 103, a suction pump 183, an ink draw-in solenoid valve 184, a collection pump 114, a collection solenoid valve 185, a solvent supply pump 186, and a solvent solenoid valve 187.

The ink container 101 stores ink therein. The ink supply solenoid valve 181 performs opening/closing functions of an ink supply flow channel extending from the ink container 101 to a nozzle 131. The ink pump 102 draws ink from the ink container 101 and pressure-feeds the ink through the ink supply flow channel. The pressure-regulating valve 103 regulates the ink pressure. The suction pump 183 draws ink remaining in a liquid chamber 132 of the nozzle 131 (described further below) when the apparatus is stopped. The ink draw-in solenoid valve 184 opens or closes an ink draw-in flow channel extending from the nozzle 131 to the ink container 101. The collection pump 114 returns unused ink droplets 108 to the ink container 101. The collection solenoid valve 185 opens or closes an ink collection flow channel 122 extending from a gutter 111, that catches the unused ink droplets 108, to the ink container 101. The solvent supply pump 186 pressure-feeds the solvent to the nozzle 131 from a solvent container 188 storing the solvent that performs nozzle cleaning when the apparatus is stopped. The solvent solenoid valve 187 opens or closes a solvent supply flow channel extending from the solvent container 188 to the nozzle 131.

In the event of printing, in the main body 600, ink flows sequentially by way of the ink container 101, the ink supply solenoid valve 181, the ink pump 102 that pressure-feeds the ink, and the pressure regulating valve 103. The ink transferred from the main body 600 reaches the print head 610 through the ink flow channel in the print head cable 620.

The ink supplied to the print head 610 is supplied to the nozzle 131 by way of a three-way valve 182 that changes between the supplied ink and solvent for supply. Having been ejected from the nozzle 131, the pressurized ink is continuously formed into atomized ink droplets 108 by vibrations and surface tension. The atomized ink droplets 108 are then electrically charged with a charging electrode 107. A recording signal source (not shown) is coupled to the charging electrode 107. When a recording signal voltage is applied to the charging electrode 107, electric charges are supplied to the ink droplets 108 continuously formed by being ejected from the nozzle 131.

The charged ink droplets 108 are deflected in the dispersion direction by an upper deflecting electrode 109 and a lower deflecting electrode 110. The upper deflecting electrode 109 is coupled to the high voltage power supply and the lower deflecting electrode 110 is grounded. An electrostatic field is thereby formed between the upper deflecting electrode 109 and the lower deflecting electrode 110. The ink droplets 108 are dispersed by being deflected corresponding to the amount of charge, and then adhere on a recording medium, whereby printing is performed.

The ink collection flow channel 122 includes the gutter 111 disposed in the print head 610 and a filter 112, collection pump 114 disposed in the mainbody's lower portion 680, and pipelines connecting among these components. Ink droplets 108 not charged by the charging electrode 107, that is, ink droplets 108 unused for printing, are collected into the ink container 101. The ink that has returned to the ink container 101 is mixed with ink stored in the ink container 101, and are the ink is reused for printing.

When the apparatus is stopped, the ink supply solenoid valve 181 is switched to the close state to thereby stop the supply of ink. In addition, the solvent solenoid valve 187 is opened, and the solvent side of the three-way valve 182 is opened, whereby the solvent is supplied to the nozzle 131 and the interior of the nozzle 131 is cleaned. During the cleaning process, the collection solenoid valve 185 is opened, and the collection pump 114 is turned to an operation mode, whereby the solvent ejected from the nozzle 131 is collected into the ink container 101.

Upon completion of the cleaning operation, which is performed for a predetermined time period, supply of the solvent is stopped by closing the solvent solenoid valve 187. The ink draw-in solenoid valve 184 and the ink side of the three-way valve 182 are then opened, and residual solvent in the nozzle 131 is thereby collected into the ink container 101.

In conventional configurations, two independent flow channels are included, namely a nozzle supply flow channel and an ink draw-in flow channel, and so miniaturization of the nozzle itself is hindered. However, in the nozzle 131 according to the present embodiment, a single flow channel is provided, and a joint 144 connecting the ink supply pipeline to the nozzle 131, with the ink draw-in pipeline provided as well. In this way, the nozzle of the present embodiment is reduced size relative to conventional nozzles. The size reduction of the nozzle also contributes to miniaturization of the print head cable 620.

Figure 4:
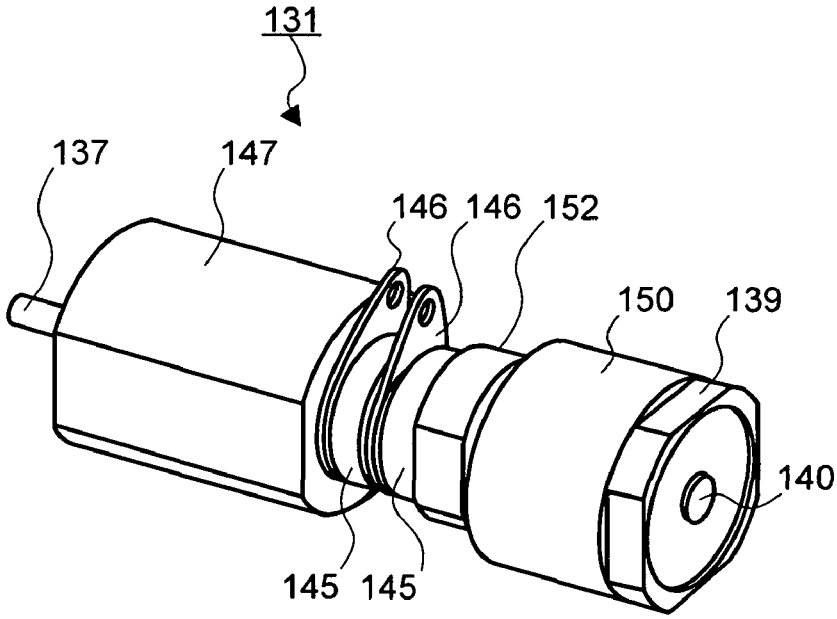
FIG. 4 is an exterior view of a nozzle according to a second embodiment of the present invention.
Figure 5:
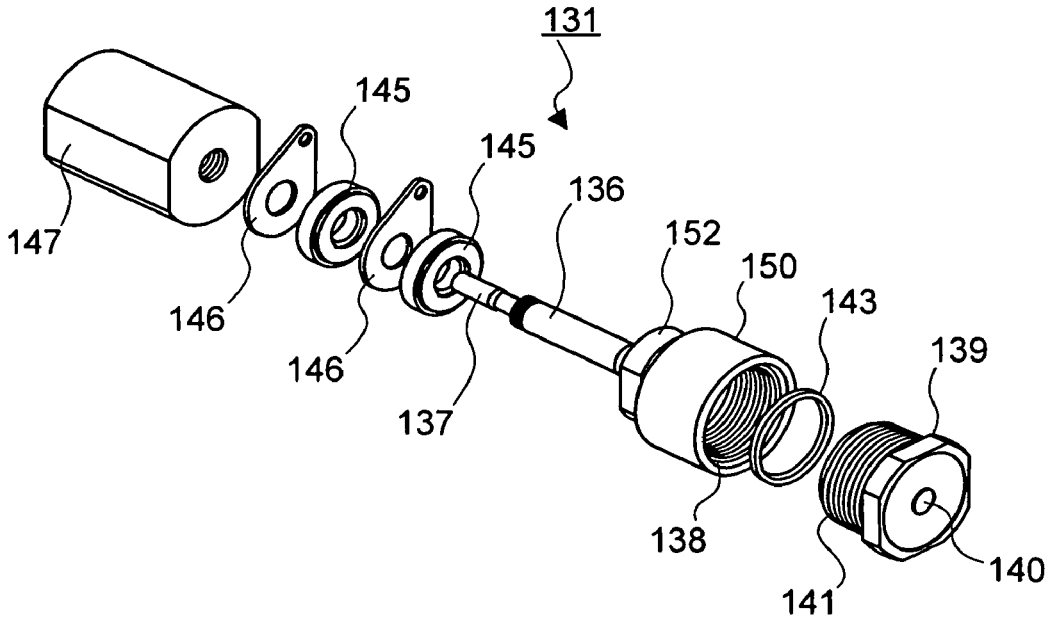
FIG. 5 is a view of the configuration of the nozzle shown in FIG. 4.

The configuration of the nozzle 131 according to the present embodiment will be described below. The exterior of the nozzle 131 will first be described with reference to FIGS. 4 and 5.

In the nozzle 131, an orifice 139 having an ejection port 140, from which ink is ejected, is threadably secured to a nozzle head 150. The nozzle head 150 is a cylindrical component in which an exciting wall 134 serves as a bottom portion, while the other end (the outer end) is open. The exciting wall 134 serving as the bottom portion of the nozzle head 150 is provided with a wall thickness less than wall thicknesses of other wall portions of the nozzle head 150. An orifice-mounting internal thread portion 138 is provided to an inner wall of the nozzle head 150, and an external thread portion 141 is provided on the outer circumference of the orifice 139. The orifice 139 is threadably secured to the nozzle head 150, as described above.

A seal component 143 for sealing ink is provided between an end portion of the exciting wall 134 of the nozzle head 150 and an end portion of the orifice 139 on the side of the exciting wall 134. The nozzle head 150 forms a liquid chamber 132 (a space in which ink temporarily resides), which is described further below, in cooperation with the orifice 139 and the seal portion 143.

On the side opposite the orifice 139, the nozzle head 150 is connected with a vibration source mounting axis 136. The vibration source mounting axis 136 is provided with, sequentially from the side of the nozzle head 150, a neck-shaped portion 155, a stopper portion 152, vibration sources 145, and power supply terminals 146. The components mounted on the vibration source mounting axis 136 are secured using a vibration source securing portion 147. In addition, an ink guide channel 137 protrudes along the opposite direction as viewed from the side of the vibration source 145 of the vibration source securing portion 147.

Liquids, such as ink and solvent, transferred from the main body 600, are guided into the nozzle 131 when the ink guide channel 137 and three-way valve 182 provided in the nozzle 131 are connected together through a flow channel, such as a pipe or hose.

Respective components will be further described below with reference to FIGS. 6 and 8.

Figure 6:
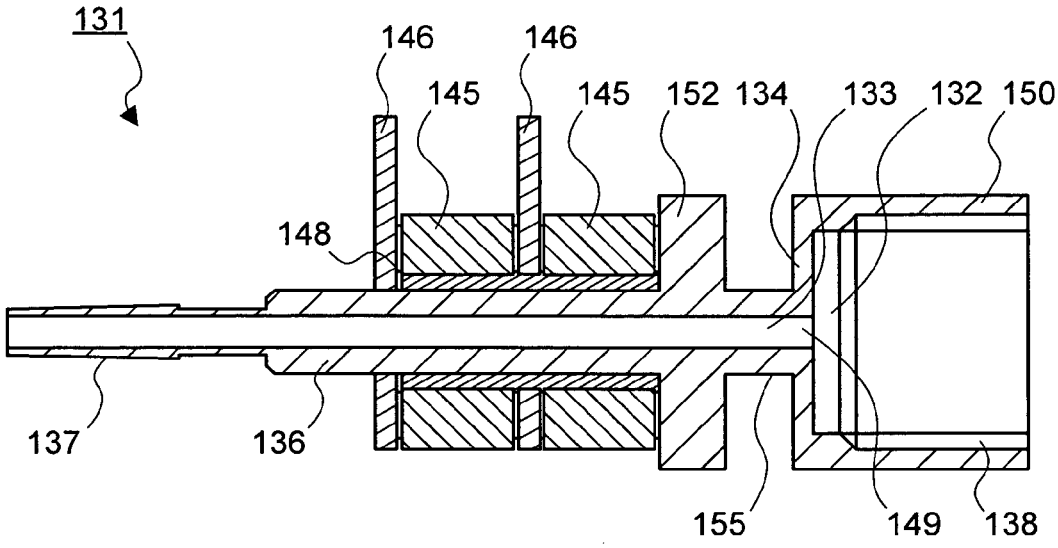
FIG. 6 is a cross sectional view of a nozzle according to the second embodiment.

In FIG. 6, the nozzle 131 is shown in a configuration in which the orifice 139 and the vibration source securing portion 147 are not yet mounted in the nozzle 131. The cross sectional view shows a linear array of components comprised of a liquid flow channel in the ink guide channel 137, a flow channel 133 in the vibration source-mounting axis 136, and an opening 151 that is provided to the exciting wall 134 of the nozzle head 150 and that works as a liquid inlet of the liquid chamber 132. In the present embodiment, the nozzle head 150, the vibration source mounting axis 136, and the ink guide channel 137 are integrally provided as one component. In this case, processing is facilitated when, as described above, a linear array of components comprised of the liquid flow channel in the ink guide channel 137, the flow channel 133, and the opening 151 is provided. Alternatively, even when at least the nozzle head 150 and vibration source mounting axis 136 are integrally provided as one component, similar effects can be obtained.

The vibration source mounting axis 136 to be connected to the ink guide channel 137 includes, in its interior, the flow channel 133 through which liquids such as ink and solvent flow. The respective vibration sources 145 and the respective power supply terminals 146 supplying electric power to vibration sources 145 are alternately disposed in such a manner as to surround the circumference of the flow channel 133. Among the plurality of vibration sources 145, a vibration source 145 close to the nozzle head 150 abuts the stopper portion 152. The vibration sources 145 and the vibration source mounting axis 136 are secured with one another via an adhesive layer 148.

Figure 9:
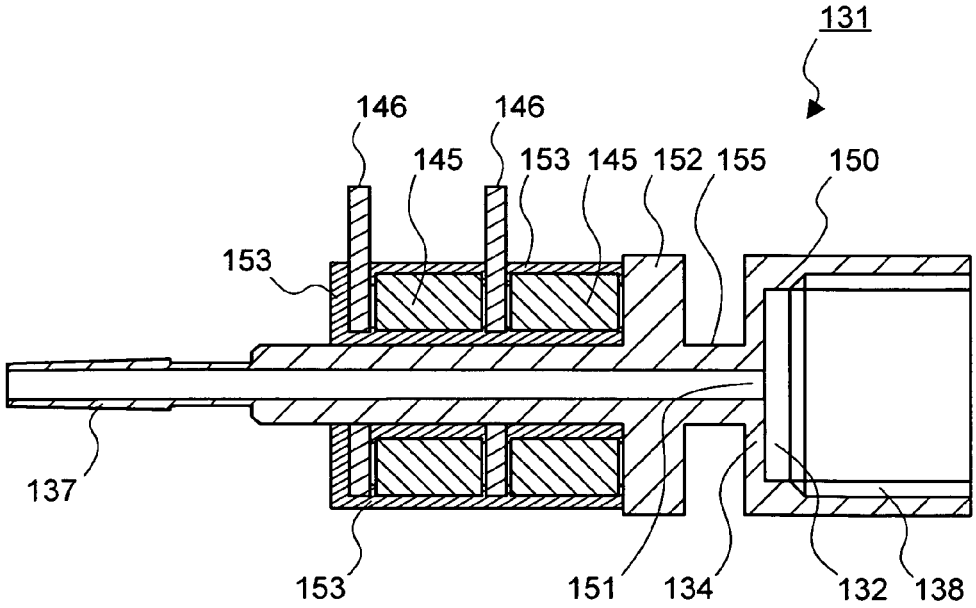
FIG. 9 is a cross sectional view of a nozzle according to a modified example of the second embodiment.

FIG. 9 shows another embodiment of the present invention in which the vibration sources 145 and the power supply terminals 146 are secured by using the adhesive layer 148. In the example of FIG. 9, a resin layer 153 is provided, and the vibration sources 145 and the power supply terminals 146 are molded by using the resin layer 153. The resin layer 153 may be formed from an adhesive.

Figure 7:
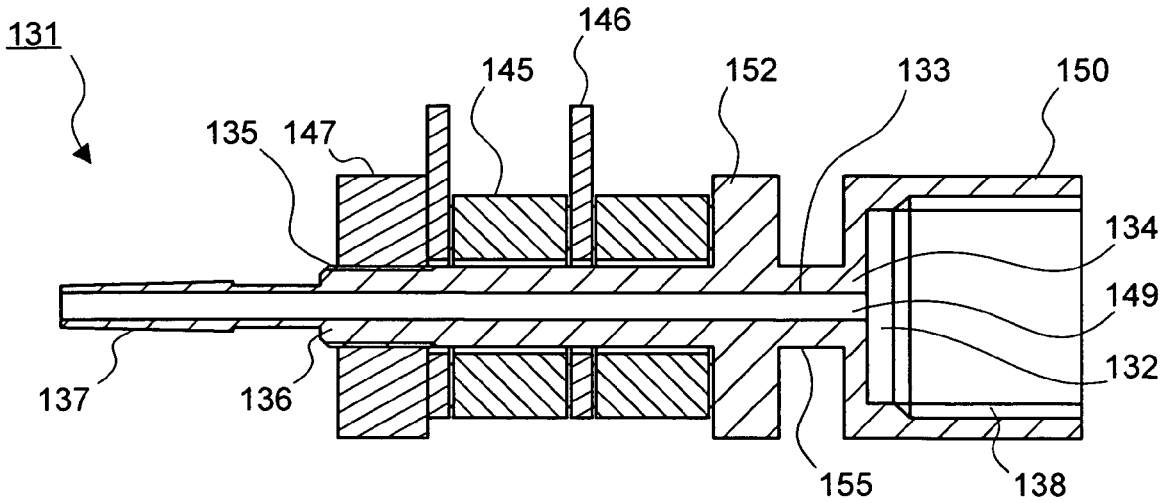
FIG. 7 is a cross sectional view of the nozzle according to the second embodiment.

The example of the nozzle 131 in FIG. 7 is shown in a configuration in which the vibration source securing portion 147 is already mounted. In the present embodiment, a vibration source securing portion mounting external thread portion 135 is provided on the outer circumference portion of the vibration source mounting axis 136, and the vibration source securing portion 147 is secured to the vibration source mounting axis 136. With the vibration source securing portion 147 thus secured to the vibration source mounting axis 136, the vibration source 145 is secured via the power supply terminals 146 that transfer electric power being used as drive forces of the vibration source 145.

The vibration source 145 may be secured to the vibration source-mounting axis 136 by using an adhesive and without using the vibration source securing portion 147. The vibration source securing portion 147 works as a counterweight in the exciting portion of the vibration source 145, the power supply terminals 146, the stopper portion 152, and the vibration source-mounting axis 136. However, in a case in which an adjusting device is necessary for vibration of the exciting wall 134, the vibration-source securing portion 147 may be provided in addition to the orifice-mounting internally threaded portion 138 of FIG. 6.

Figure 10:
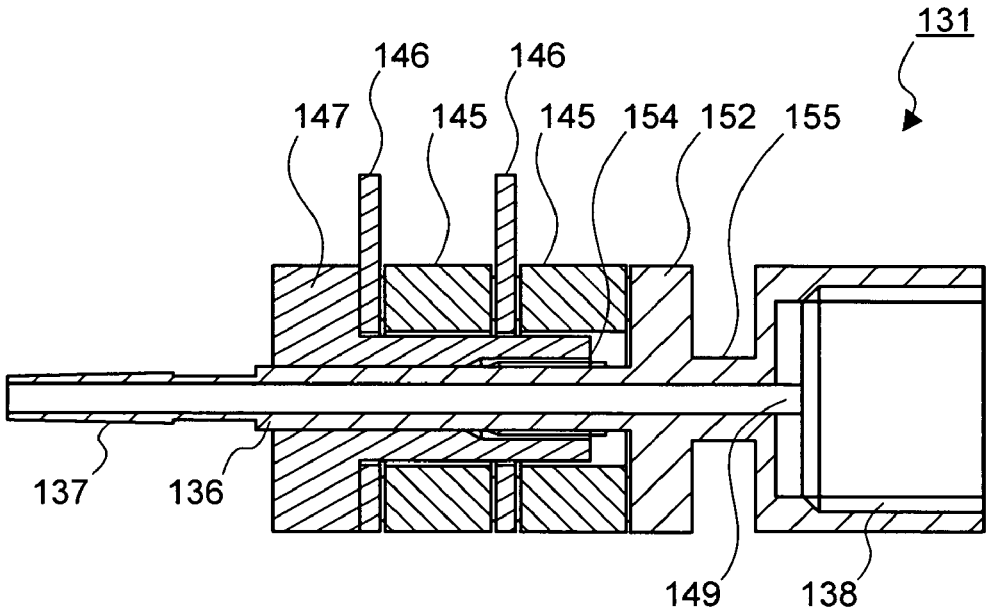
FIG. 10 is a cross sectional view of a nozzle according to a modified example of the second embodiment.

FIG. 10 shows another embodiment of the vibration source-securing portion 147 shown in FIG. 7. The vibration source-securing portion 147 shown in FIG. 10 has a configuration in which a cylindrical portion extending between the vibration source 145, the power supply terminals 146, and the vibration source mounting axis 136 is added to the vibration source securing portion 147. The vibration source-securing portion 147 shown in FIG. 10 compresses a connecting portion 154 to the stopper portion 152 to thereby secure the vibration sources 145 and the power supply terminals 146. The connecting portion 154 includes an internal thread portion provided in a portion opposing the vibration source-mounting axis 136 and an external thread portion provided on the vibration source-mounting axis 136 to oppose the internal thread portion. This configuration is effective in case the weight of the vibration source-securing portion 147 is insufficient to work as a counterweight.

Figure 8:
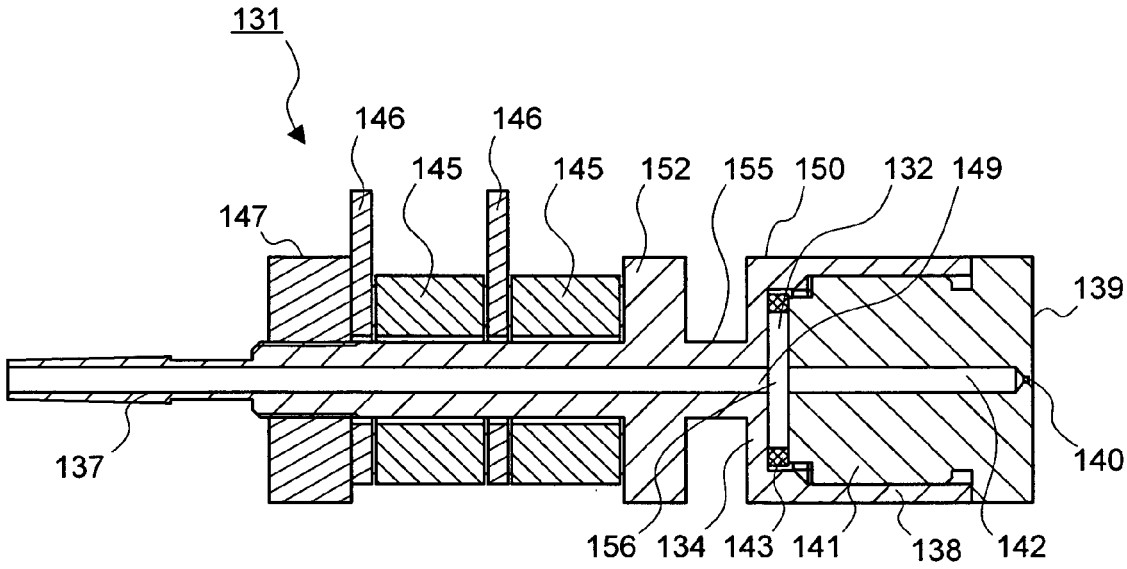
FIG. 8 is a cross sectional view of the nozzle according to the second embodiment.

In an example of the nozzle 131 in FIG. 8, according to the present embodiment, the vibration source-securing portion 147, and the orifice 139 are shown in mounted configurations. In the example shown in FIG. 8, the vibration sources 145 and the power supply terminals 146 are secured by using the vibration source securing portion 147.

The nozzle 131 and the orifice 139 are connected together via the orifice-mounting internal thread portion 138 provided to the liquid chamber 132 of the nozzle 131 and the external thread portion 141 that engages with the thread portion 138 and that is provided in the orifice 139. The orifice 139 has on the central axis an ink flow channel 142 including the ejection port 140. In order to prevent ink leakage, engagement portions of the nozzle 131 and the orifice 139 are intimately fastened by the seal 43.

The liquid, such as ink or solvent, passes through the ink guide channel 137 and the flow channel 133 provided in the interior of the vibration source-mounting axis 136 that incorporates one end of the ink guide channel 137. The liquid then flows into the liquid chamber 132 from an exciting wall opening portion 149 provided in the exciting wall 134 connected to the vibration source mounting axis 136.

The liquid chamber 132 is a space defined by the exciting wall 134, an inner wall of the nozzle head 150 on which the exciting wall 134 is provided, and an opposite face opposing the exciting wall 134 of the orifice 139. An ink outlet port 156 is provided in the opposite face, is in communication with the ink flow channel 142, and is fluidly connected to the ejection port 140 via the ink flow channel 142.

A liquid having been pressure-fed into the liquid chamber 132, such as ink having been pressure-fed during the printing of the apparatus, receives a vibration of the exciting wall 134 transferred by a vibration generated by the vibration source 145 (described further below). The ink is simultaneously ejected from the ejection port 140 of the orifice 139 and then is formed into the ink droplets 108. Due to the range of vibrations applied by the exciting wall 134, the space provided in the ejection port 140 may be extended and included in the orifice 139 can be included in the liquid chamber 132.

The exciting wall 134 constitutes a part of the nozzle head 150 and connects to the vibration source mounting axis 136, which works also as the ink flow channel. The vibration generated from the vibration sources 145 is transferred to the exciting wall 134 by way of the vibration source-mounting axis 136 that is present between the stopper portion 152 and the exciting wall 134. The stopper portion 152 provides spacing between the exciting wall 134 and the vibration source 145.

In the structure described above, ink supplied from the main body 600 to the print head 610 is supplied from the ink guide channel 137 into the liquid chamber 132, which is formed in the nozzle head 150, through the opening portion provided in the exciting wall 134. In this case, the ink is supplied by way of the flow channel 133 provided in the vibration source-mounting axis 136.

The flow channel 133, which works as the liquid supply flow channel through which the ink or solvent flows, is provided in the interior of the vibration source-mounting axis 136 that transfers to the exciting wall 134 the vibration generated from the vibration source 145. That is, the component for transferring the vibration to the liquid chamber 132 is simultaneously used as the liquid supply flow channel. Consequently, the structure of the nozzle 131 is simplified, and hence the number of components can be reduced.

The ink supplied into the liquid chamber 132 is excited by the exciting wall 134, is transferred by way of the ink flow channel 142 provided in the orifice 139 assembled with the nozzle 131, and then is ejected from the ejection port 140. The ink ejected from the ejection port 140 is formed into regular ink droplets 108 due to the effects of vibration received from the exciting wall 134. In this case, however, there is a probability that, since the flow channel 133 has the vibration sources on its circumference, a fluid resonance is caused in the interior of the flow channel 133 by the vibration of the vibration source mounting axis 136. In the present embodiment, in order to prevent such fluid resonance, the lengths of the respective vibration source mounting axis 136 and ink guide channel 137 are set to a length not causing the fluid resonance.

In any of examples of the nozzles 131 described above, the exciting wall 134, the vibration source mounting axis 136, and the ink guide channel 137 are integrally and linearly provided as s single component. In addition, the flow channel 133 is provided to extend through the component along the central axis thereof. Thus, the vibration source mounting axis 136, the exciting wall 134, and the nozzle head 150 are integrally provided, so that the individual variation associated with nozzle assembly is reduced, and further, the problem of variation in the amplitude of displacement of the exciting wall 134 is reduced.

Further, since the ink guide channel 137 is integrally provided to the end portion of the vibration source mounting axis 136 on the side opposite to the exciting wall 134, the volume of space occupied by the nozzle 131 in the print head 610 can be reduced.

In the respective embodiment of the present invention, the pipeline connecting to the ink guide channel 137 is a pipeline formed of at least a resilient material. In order for the vibration source-mounting axis 136 connecting to the exciting wall 134 to transfer a necessary vibration to the exciting wall 134, the flow channel connected to the vibration source-mounting axis 136, that is, the exciting wall 134, should not be secured. Otherwise, if secured, a necessary amount of vibration cannot be obtained. At least, the ink guide channel 137 provided integrally with the flow channel connecting to the exciting wall 134 has to be vibratably connected to the pipeline.

Inasmuch as the components are secured to enable transference of the vibration generated from the vibration source 145 to the vibration source mounting axis 136, the manner of securing the vibration source 145 and the power supply terminals 146 to the vibration source mounting axis 136 is not limited to the securing methods shown in FIGS. 6, 7, 9, and 10.

Figure 13:
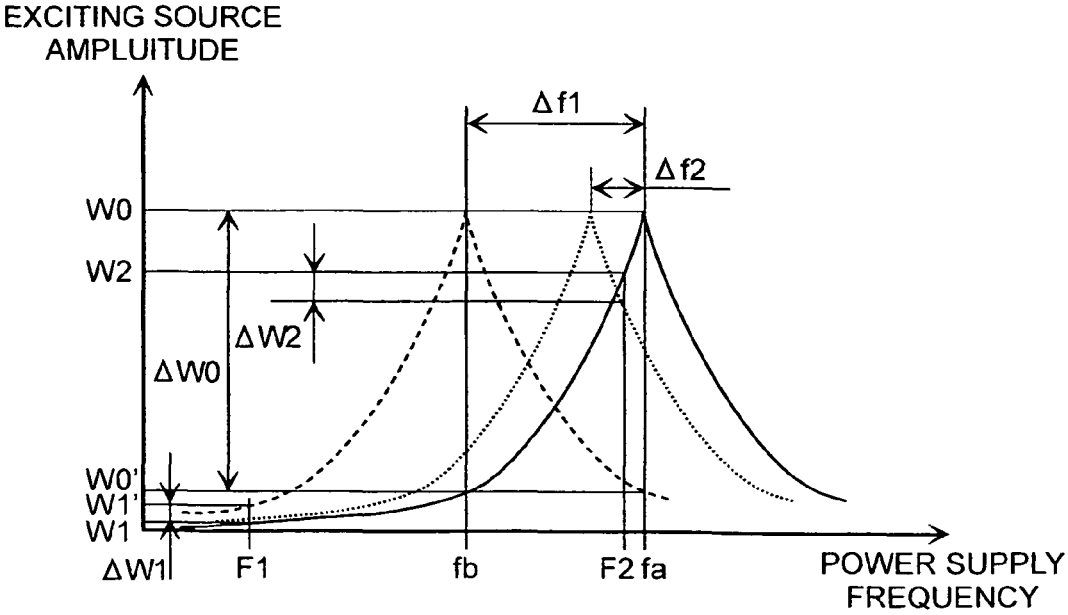
FIG. 13 is an explanatory graph showing an amplitude characteristic of an exciting wall of the nozzle.

Influences due to variations in individual nozzles will be described with reference to FIG. 13. FIG. 13 is an explanatory graph showing characteristics the amplitude of displacement of the exciting wall 134 versus the exciting source.

In the event that the drive source of the nozzle is converted from electric energy to mechanical energy, one vibration characteristic that may be noted is that the amplitude increases as the frequency approaches a resonance point fa that represents an eigen frequency of the nozzle.

In an inkjet recording apparatus in which ink droplets are charged, and the dispersion direction of the ink droplets is controlled, the ink is dropped (atomized) by using a certain fixed frequency. In this case, the frequency preferably reaches the resonance point fa, at which point high efficiency of the conversion of the electric energy to the mechanical energy is achieved.

Normally, however, the individual variation associated with nozzle assembly, the nozzle resonance point fa tends to vary in units of or per nozzle. For example, it is now assumed that a nozzle is provided that has characteristics including a resonance point fb. In this case, when the frequency of the power supply is kept unchanged from fa, the amplitude of the exciting wall is changed from W0 to W0' with the reduction of ΔW0, whereby the problem arises where an amount of vibration necessary for atomizing ink cannot be obtained.

Further, a variation in displacement amplitude corresponding to a power supply frequency variation in amplitude is increased by ΔW as the usage frequency approaches the resonance point, so that, when a frequency close to the resonance point fa is used, there occurs the same problem.

In order to prevent the problem, the usage frequency can be set to a frequency F1 that is greatly different from the resonance point. As a consequence, even when a nozzle having characteristics including the resonance point fb has been produced, the displacement amplitude of the exciting wall is varied from W1' to W1, so that the amount of variation can be minimized to a small variation amount ΔW1. However, conventionally, when the amplitude variation mount W1' is small relative to W0, the area size of the exciting wall has to be set correspondingly large to increase the vibration energy.

Thus, conventionally, there has been the tendency that, when the individual variation of the nozzle is increased in association with the manufacture, assembly, and the like of the nozzle including a complex ink flow channel system, the resulting energy conversion efficiency is resultantly reduced.

However, in the case of the nozzle according to the present embodiment, the individual variation associated with manufacturing, assembly, and the like of conventional components can be minimized. As a consequence, a resonant frequency difference Δf1, that occurs in association with the individual variation found in the assembly of individual nozzles, can be minimized to Δf2. Further, even when a usage frequency conventionally set to the usage frequency F1 (that is significantly different from the resonance point) is re-set to a frequency F2 closer to the resonance point, an amplitude variation amount ΔW2 can be equalized to ΔW1. Therefore, although the amplitude amount can be conventionally set only to the amplitude W1, the amplitude amount can be increased to the amplitude W2 in the present embodiment. Consequently, although the area size of the exciting wall 134 is reduced by the area size of the flow channel 133, the necessary amount of vibration can be obtained.

According to the present embodiment, the flow channel system in the nozzle is simplified to thereby enable the number of components of the nozzle to be reduced. The nozzle individual variation can thereby be reduced. In addition, miniaturization of the nozzle can be implemented. Further, with the miniaturized nozzle, a inkjet recording apparatus with the miniaturized print head can be provided.

Third Embodiment

Figure 17:
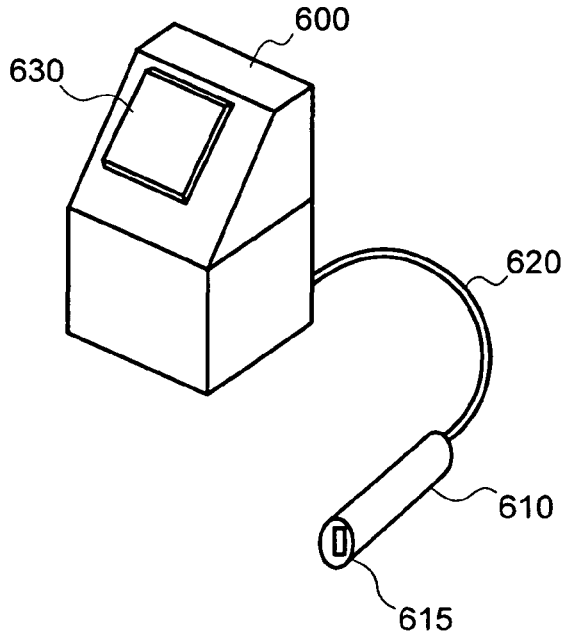
FIG. 17 is an exterior view of an inkjet recording apparatus according to the third embodiment.

A third embodiment will be described below with reference to the drawings. FIG. 17 shows an exterior view of an inkjet recording apparatus according to a third embodiment of the present invention. The inkjet recording apparatus has a configuration that includes a main body 600 containing a control system and a circulation system, a print head 610 including a nozzle that produces ejection ink droplets, and a print head cable 620 that is connected with the main body 600 and the circulation system and control system of the print head 610. The main body 600 includes a touchpanel-type liquid crystal panel 630 that permits the user to input, for example, print contents and print specifications and that is capable of displaying, for example, control contents and apparatus operation status. The print head 610 includes the nozzle, which produces ink droplets, and electrodes and the like that control dispersion of ink droplets. An opening 615 is provided in one end face of the cover through which ink droplets can travel for use in printing.

Figure 16:
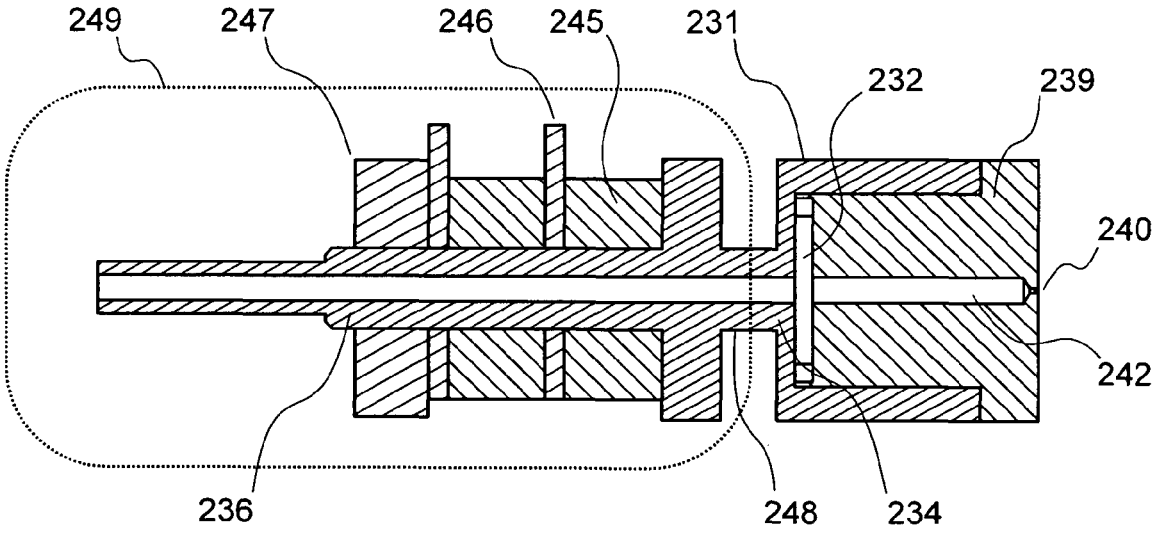
FIG. 16 is a cross sectional view of the nozzle according to the third embodiment.
Figure 18:
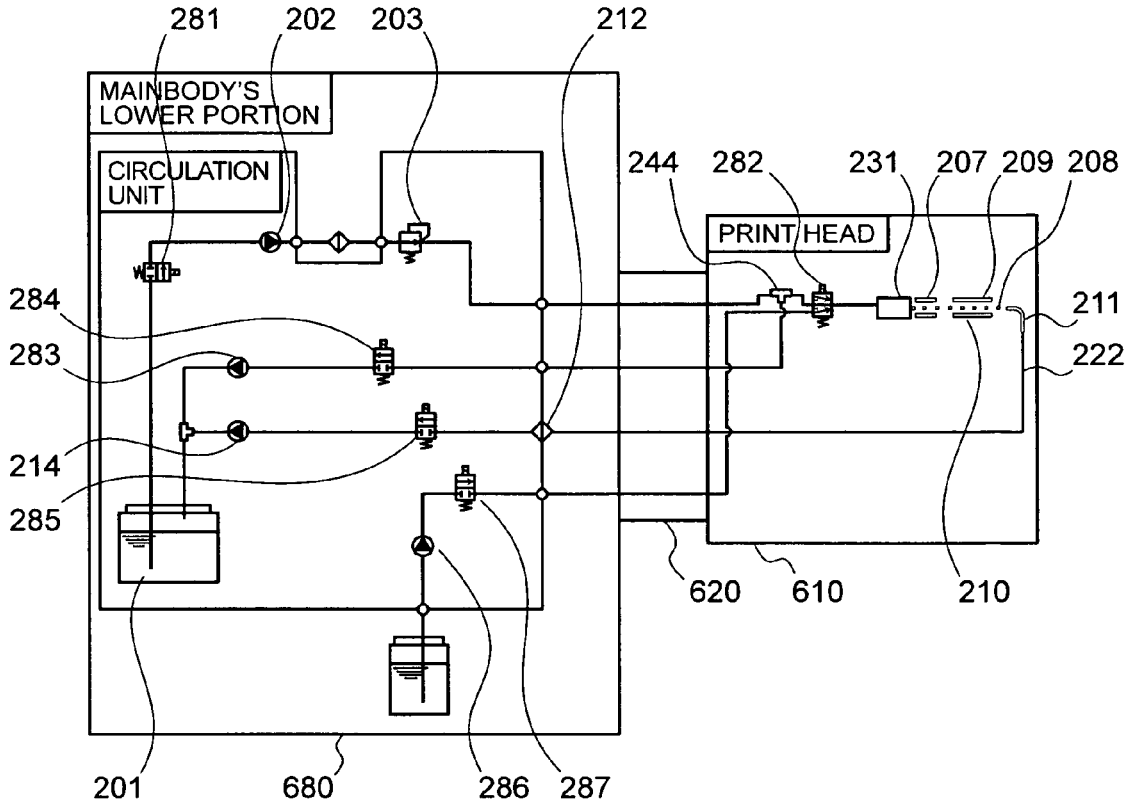
FIG. 18 is a simplified view of a circulation channel system of the inkjet recording apparatus according to the third embodiment.
Figure 19:
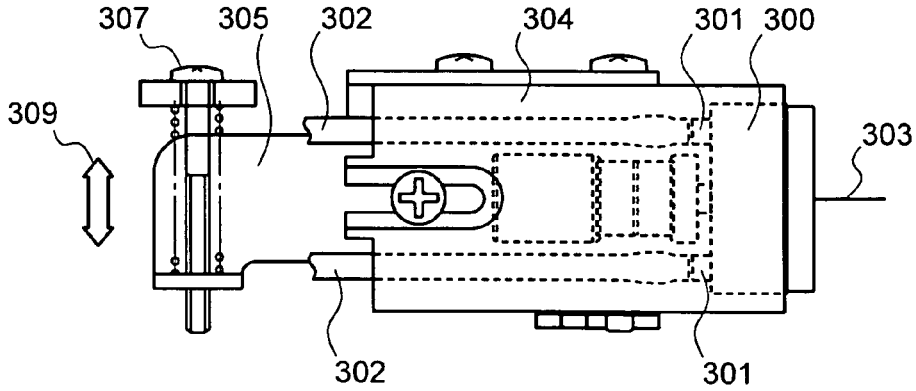
FIG. 19 is a plan view of a nozzle according to a conventional configuration.
Figure 20:
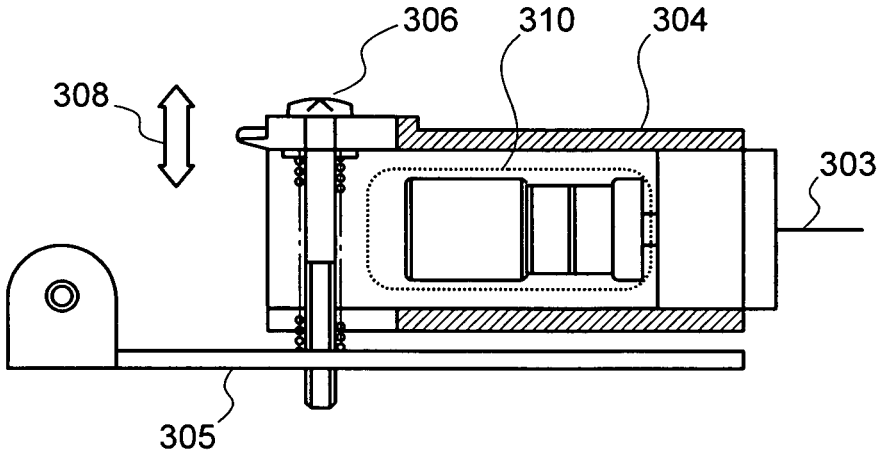
FIG. 20 is a front view of a nozzle according to a conventional configuration.
Figure 21:
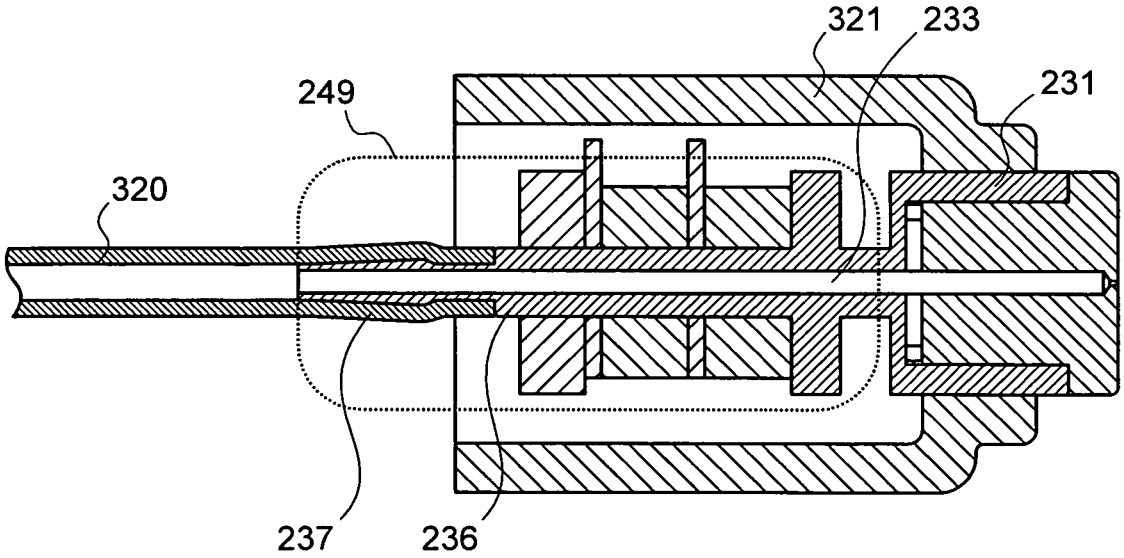
FIG. 21 is a cross sectional view of a compact nozzle according to a conventional configuration.

FIG. 18 is a simplified view of an ink circulation channel system of the inkjet recording apparatus. FIG. 16 is a cross sectional view of the nozzle. Circulation system control components are disposed in a mainbody's lower portion 680. The circulation system control components include an ink container 201, an ink supply solenoid valve 281, a pump 202, a pressure regulating valve 203, a suction pump 283, an ink draw-in solenoid valve 284, a collection pump 214, a collection solenoid valve 285, a solvent supply pump 286, and a solvent solenoid valve 287.

Ink is stored in container 201. The ink supply solenoid valve 281 performs opening/closing functions of an ink supply flow channel. The pump 202 draws ink from the ink container 201 and pressure-feeds the ink through the ink supply flow channel. The pressure regulating valve 203 regulates the ink pressure. When printing is stopped, the suction pump 283 draws ink remaining in an ink chamber 232 that is provided in a nozzle 230 and that works as a liquid chamber filled with, for example, ink or solvent. The ink draw-in solenoid valve 284 performs opening/closing functions of an ink draw-in flow channel. The collection pump 214 returns unused ink droplets 208 to the ink container 201. The collection solenoid valve 285 performs opening/closing functions of an ink collection flow channel. The solvent supply pump 286 pressure-feeds the solvent to the nozzle 230 from a solvent container 188 that stores the solvent that performs nozzle cleaning in the apparatus-stopping event. The solvent solenoid valve 287 performs opening/closing functions of a solvent supply flow channel.

In the event of printing, ink flows sequentially by way of the ink container 201, the ink supply solenoid valve 281, the pump 202 that pressure-feeds the ink, and the pressure-regulating valve 203, and is then supplied to the print head 610 through the print head cable 620. The ink supplied to the print head 610 is supplied to the nozzle 230 by way of a three-way valve 282 that can be changed for the supply of either ink or solvent.

Figure 14:
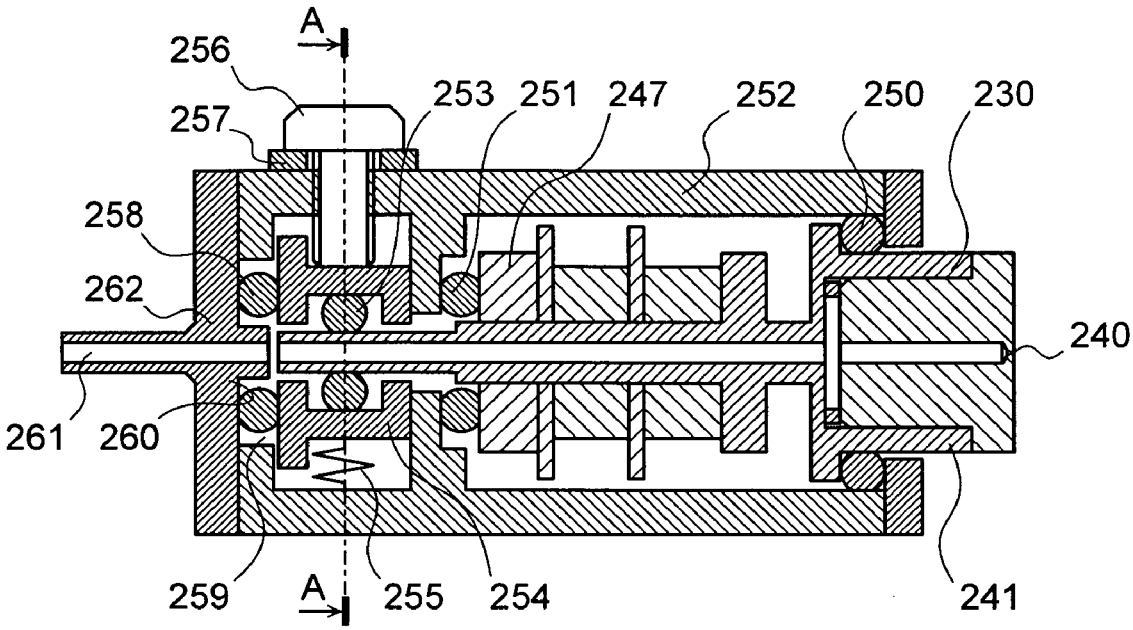
FIG. 14 is a cross sectional view showing a holding mechanism and ink stream adjusting mechanism according to a third embodiment of the present invention.

As shown in FIG. 14, the nozzle 230 includes a nozzle head portion 241 including an ejection port 240, and an exciting portion 249. In the nozzle 230, vibration sources 245 and power supply terminals 246 are mounted with a vibration source securing nut 247 to an axis 236, and a flow channel 233 is formed in the interior of the axis 236. A portion from a neck-shaped portion 248 of the nozzle 230 to the side of the vibration source securing nut 247, which includes the vibration sources 245, constitutes the exciting portion 249, whereby vibration is transferred to an exciting wall 234 of the nozzle head portion 241.

The ink supplied to the nozzle 230 passes through the flow channel 233 in the axis 236, and further passes from the ink chamber 232, which is formed with the exciting wall 234 as one wall, and passes still further by way of an ink flow channel 242 formed in the orifice 139 assembled to a nozzle body 231. The ink is then ejected from the ejection port 240. Having been ejected from the ejection port 240, the ink is continuously formed into atomized ink droplets 208 by the vibration of the exciting wall 234.

A recording signal source is coupled to a charging electrode 207. When a recording signal voltage is applied to the charging electrode 207, electric charges are supplied to the respective ink droplets 208 continuously ejected from the ejection port 240. An upper deflecting electrode 209 is coupled to the high voltage power supply and the lower deflecting electrode 210 is grounded. While voltage is applied to the upper deflecting electrode 209, an electrostatic field is formed between the upper deflecting electrode 209 and the lower deflecting electrode 210. The charged ink droplets 208 are dispersed by being deflected by a force corresponding to the amount of charge, and then adhere onto a recording medium. Respective ink droplets 208 are thus directed onto desired positions, thereby forming a character(s) or the like thereon.

Unused ink droplets 208 are caught in a gutter 211 disposed in the interior of the print head 610, are drawn in by the collection pump 214 disposed in the mainbody's lower portion 680, and are returned to the ink container 201 by way of an ink collection flow channel 222 including a filter 212. Ink returned in this way is reused for printing.

When the apparatus is stopped, the ink supply solenoid valve 281 is switched to the closed state to thereby stop supply of ink. In addition, the solvent solenoid valve 287 is opened, and the three-way valve 282 is switched to the solvent side, whereby the solvent is supplied to the nozzle 230 and the interior thereof is cleaned. During the cleaning process, the solvent ejected from the ejection port 240 is caught in the gutter 211, is passed through the ink collection flow channel 222, and is then collected into the ink container 201. After the cleaning operation has been performed for a predetermined time period, supply of the solvent is stopped by switching the solvent solenoid valve 287 to the closed state. The ink draw-in solenoid valve 284 is then switched to the open state, and the three-way valve 282 is switched to the ink side, and, through the use of the suction pump 283, residual solvent in the nozzle 230 is returned to the ink container 201.

Figure 15:
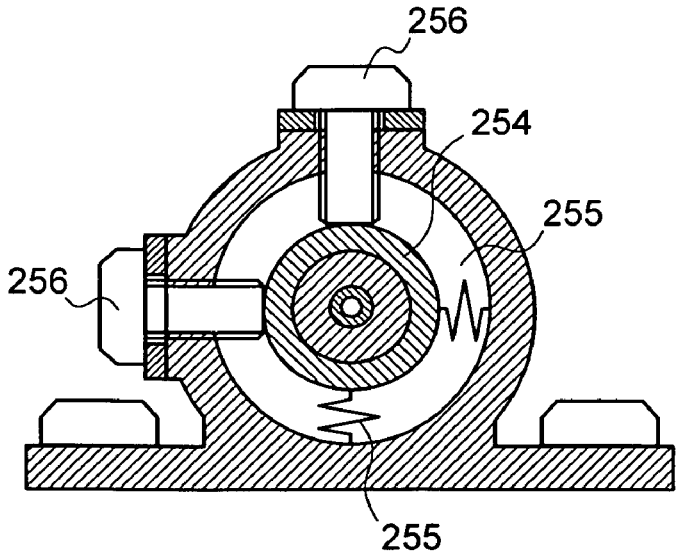
FIG. 15 is a cross sectional view of an adjusting screw center portion of the nozzle according to the third embodiment.

FIG. 14 is a cross sectional view showing the nozzle 230 according to the third embodiment, and a holding mechanism and ink stream adjusting mechanism of the nozzle. FIG. 15 is a cross sectional side view of an adjusting screw center portion of an adjusting screw 256.

The nozzle 230 is housed in a housing 252 such that an outer circumference of an ink chamber component portion is held with an elastic member 250, and an end portion of a vibration source securing portion 247 is held with an elastic member 251. A central axis of the flow channel 233 of the nozzle 230 is positioned on a central axis of the housing 252. The position in an ejection direction is determined by the elastic forces of the elastic member 250 and the elastic member 251. With use of a member such as rubber having a sealing property for the respective elastic member 250, 251, even liquid entrance from the outside can be prevented.

An outer circumference of an ink supply side of the axis 236 of the nozzle 230 has an elastic member 253 and a nozzle central axis-regulating member 254. The elastic member 253 additionally has a sealing function that prevents ink leakage. The nozzle center axis regulating member 254 is slidably movable along the vertical direction relative to the central axis of the nozzle 230. An elastic member 255 is disposed between an outer circumference of the nozzle center axis-regulating member 254 and an inner face of the housing 252, whereby external forces are continually exerted at all times on the nozzle center axis-regulating member 254 towards the central axis of the nozzle 230 from the inner face side of the housing 252. The adjusting screw 256 is engaged with the housing 252 and compressively screwed into the housing to be compressively abutted on the nozzle central axis regulating member 254.

When the adjusting screw 256 is compressively turned to be inserted, the nozzle central axis-regulating member 254 is slidably moved to the side of the elastic member 255, and concurrently, the elastic member 253 provided in the interior is slidably moved. The elastic force of the elastic member 253 moves and balances the axis 236 of the nozzle 230 with respect to the center of elastic member 253. Accordingly, a contacting portion of the elastic member 250 works as a support point, and the outer circumference of the ink chamber component portion of the nozzle 230 is not moved with optical. The ink ejection direction, i.e., ink ejection angle, can thereby be adjusted. When the adjusting screw 256 is turned back, the nozzle central axis regulating member 254 is slidably moved to the side of the adjusting screw 256 by a reaction force of the elastic member 255. The ink ejection direction (angle) in the opposite direction is thereby enabled for adjustment.

In addition, an elastic member 257, such as a spring washer, can be provided between a screw head of the adjusting screw 256 and the housing 252 to prevent screw loosening. Accordingly, as shown in FIG. 15 for example, in addition to the axial set made up of the adjusting screw 256 and the elastic member 255, one more axial set of an adjusting screw 256 and an elastic member 255 may be provided, producing an arrangement in which the two axial sets are disposed at an angle of 90 degrees. In this case, since two axial sets are used, the central axis of the nozzle can be adjusted in an arbitrary direction. The ink is supplied to the nozzle 230 through a joint 262 from, for example, an upstream component or tube.

The joint 262 is secured to the housing 252, and the interior thereof includes a seal member 258, to thereby prevent ink leakage on an edge face 259 of the nozzle central axis regulating member 254 and a joint's inner face 260. An ink flow channel 261 of the joint 262 and the flow channel 233 of the nozzle 230 are not in contact with one another, and only the flow channel 233 is moved along the central axis by the nozzle central axis regulating member 254. Associated components or tubes can thereby be rigidly connected to a joint 262.

Fourth Embodiment

A fourth embodiment will be described below with reference to the drawings.

Figure 22:
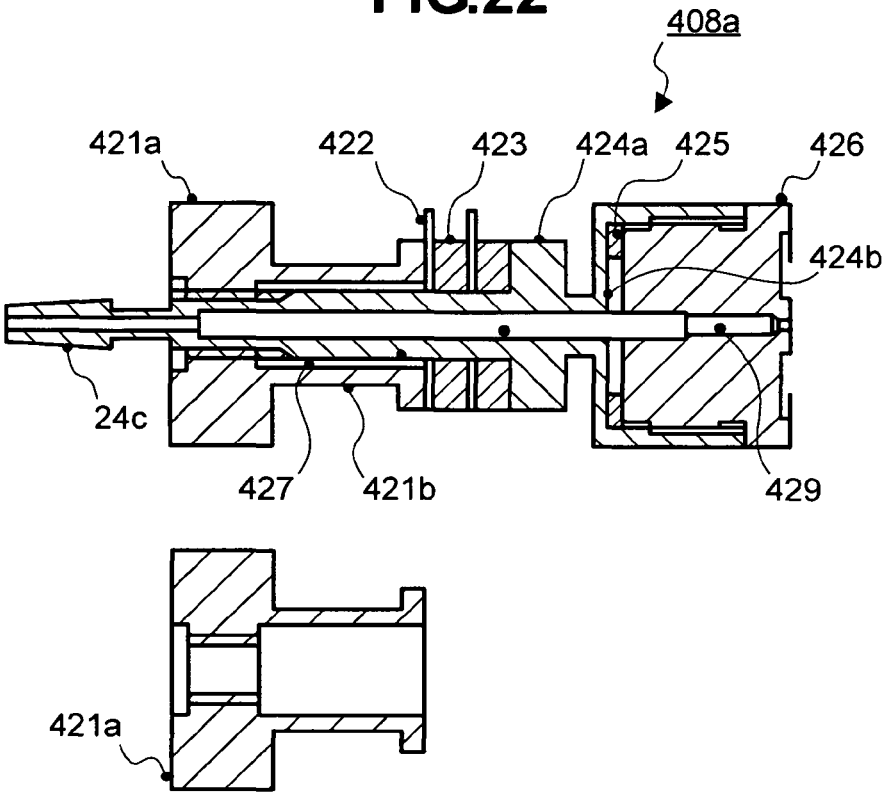
FIG. 22 is a cross sectional view of a nozzle according to a fourth embodiment of the present invention.
Figure 23:
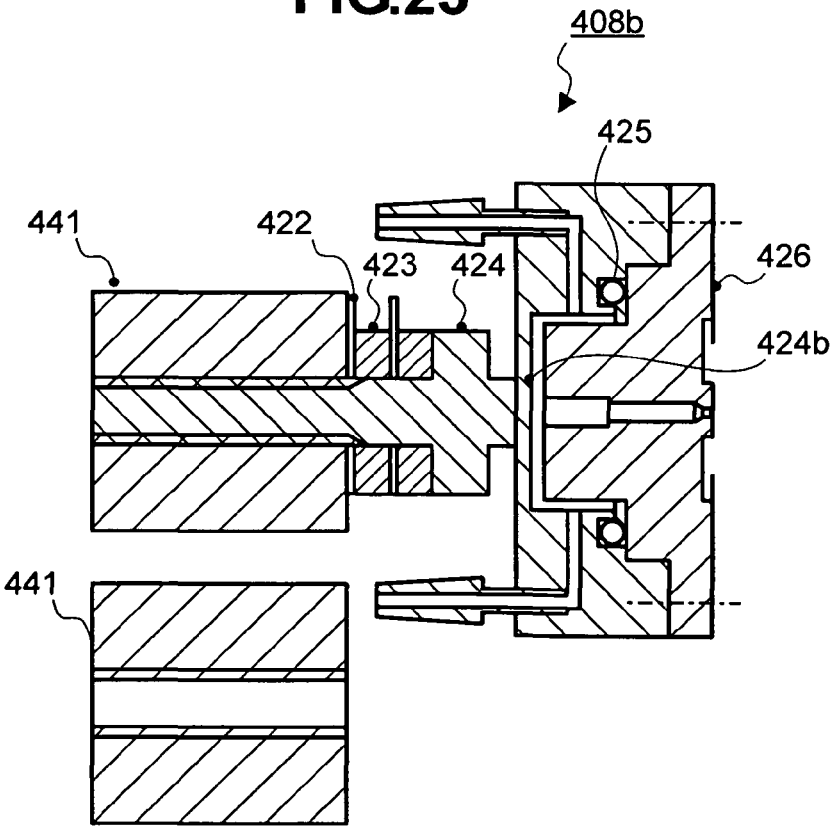
FIG. 23 is a cross sectional view of a nozzle according to a conventional configuration.
Figure 24:
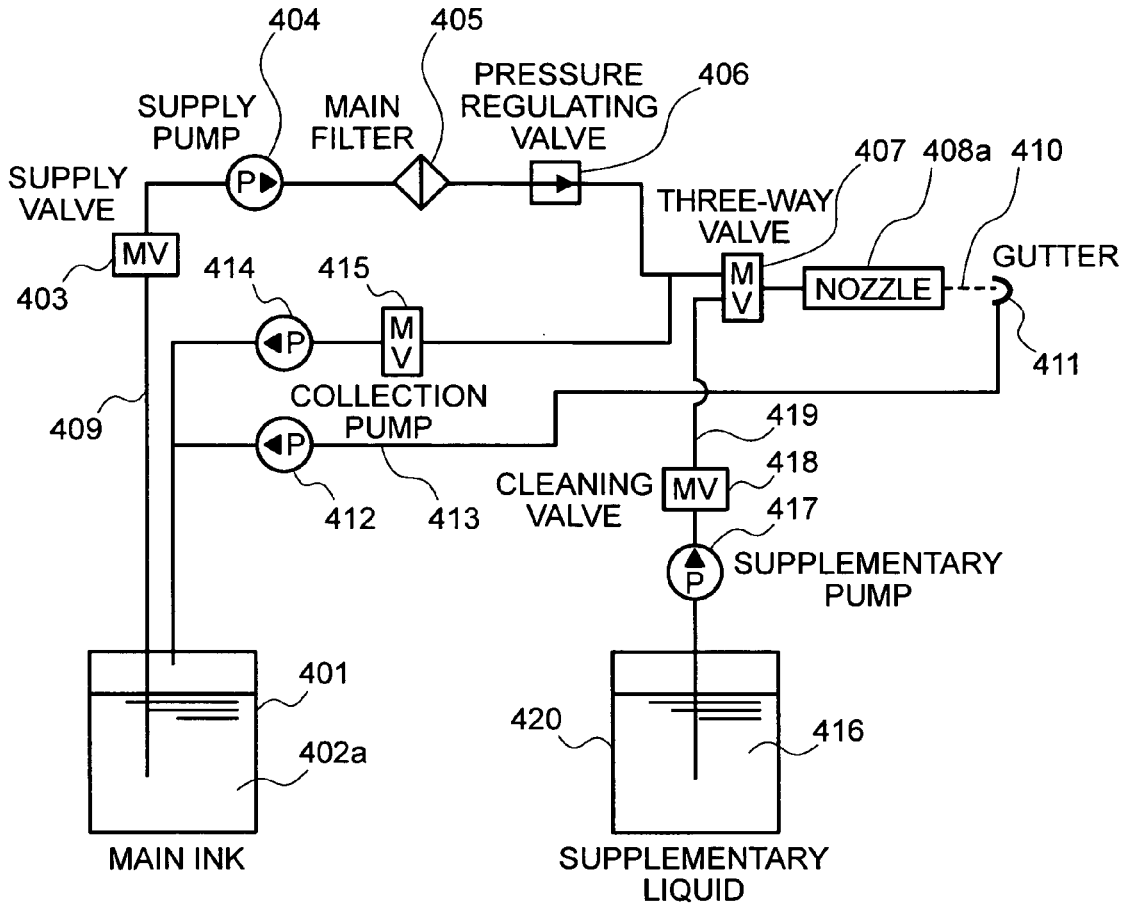
FIG. 24 is a schematic view of piping of an inkjet recording apparatus according to the fourth embodiment.
Figure 25:
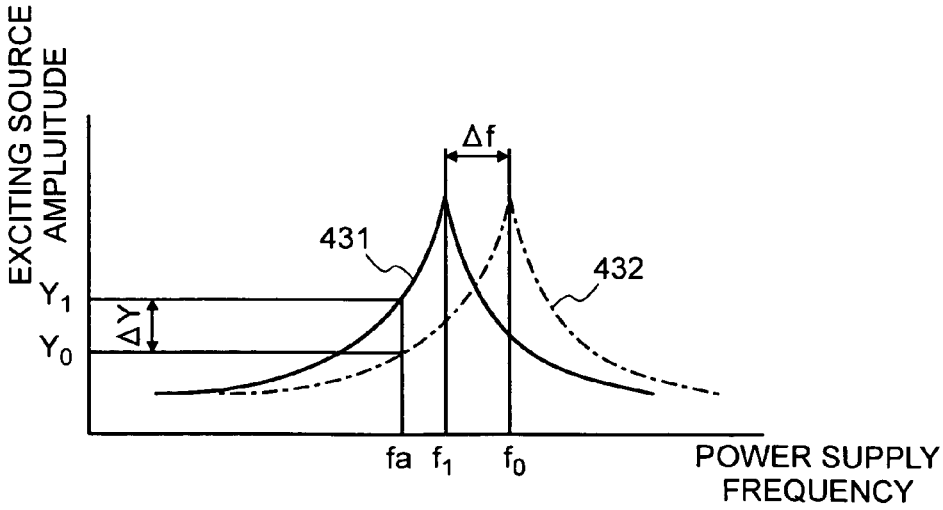
FIG. 25 is a graph showing a vibration frequency characteristic of the nozzle according to the fourth embodiment.
Figure 26:
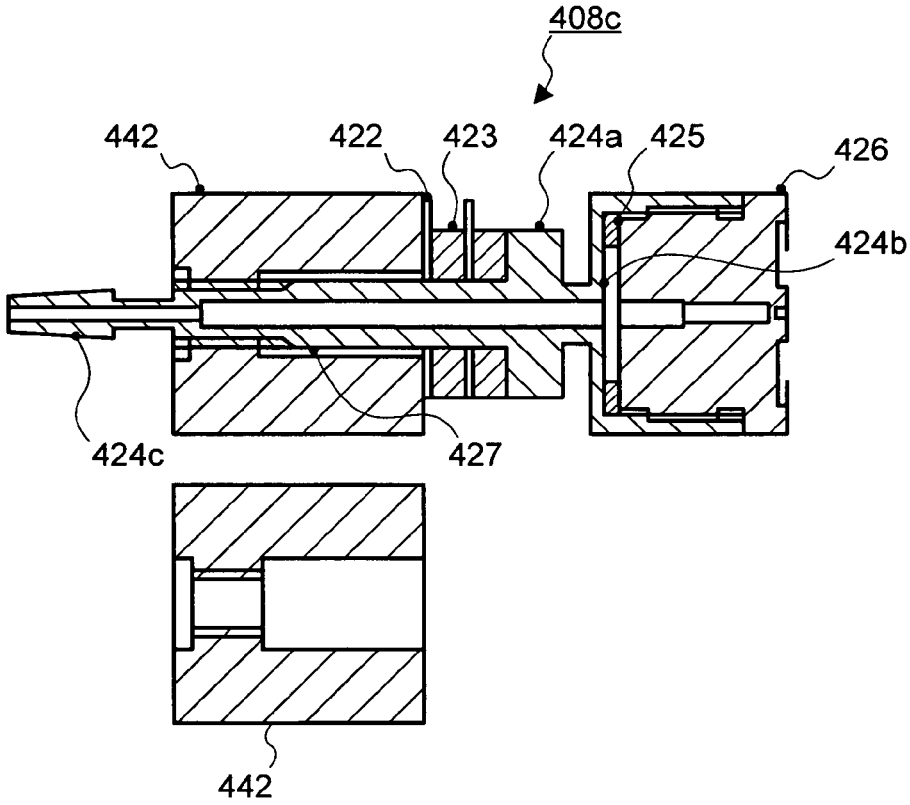
FIG. 26 is a cross sectional view of the nozzle according to the fourth embodiment.
Figure 27:
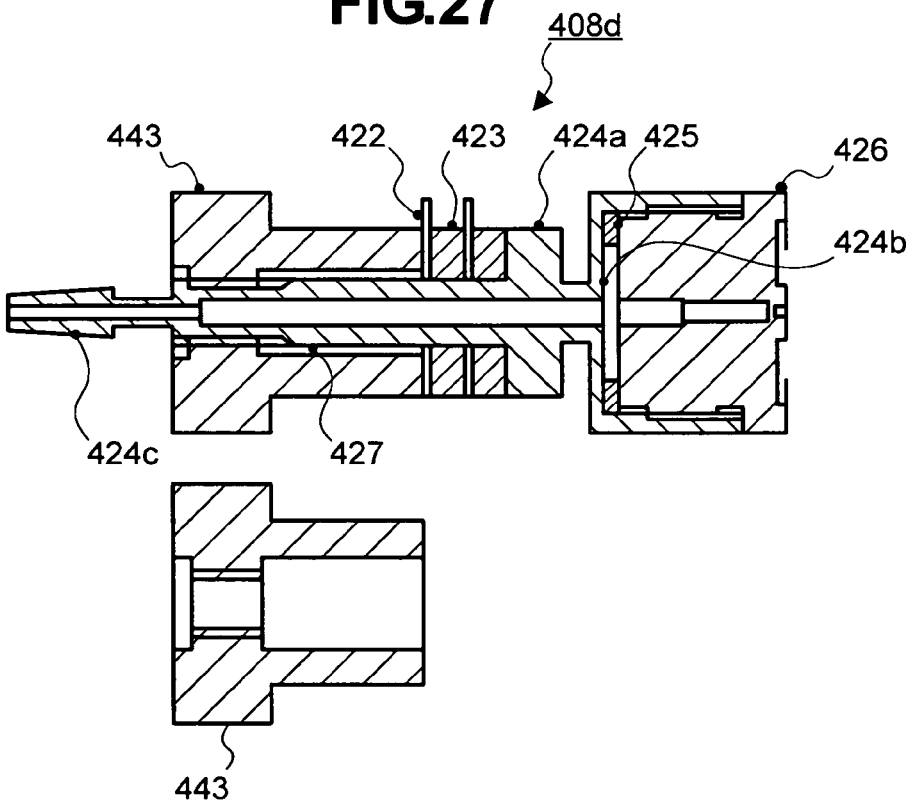
FIG. 27 is a cross sectional view of a nozzle according to a modified example of the fourth embodiment.

FIG. 22 is a cross sectional view of an assembly of a nozzle body (hereinafter, "nozzle body assembly") according to a fourth embodiment of the present invention. FIG. 23 is a cross sectional view of an assembly of a nozzle body according to a conventional example. FIG. 24 is a schematic view of the piping of an inkjet recording apparatus according to the present embodiment. FIG. 25 is a graph showing the result of comparison between the mechanical vibration frequency characteristics of the respective nozzle bodies according to the present invention and the conventional example. FIGS. 26 and 27, respectively, are cross sectional views showing nozzle body assemblies of other embodiment examples (modified examples of the fourth embodiment).

The configuration of the inkjet recording apparatus will be described below. With reference to FIG. 24, an ink **402*a* fills a main ink container 401, and is connected by an ink supply pipeline 409 to respective components, namely, a supply valve 403, a supply pump 404, a main filter 405, a pressure regulating valve 406, an ink inlet port of a three-way valve 407, and a nozzle body 408*a*. In addition, an ink collection pipeline 413 connects a gutter 411 and a collection pump 412, which collect ink droplets 410, to the main ink container 401**.

Further, an ink flow channel 450 is connected with an ink main container 401 and the three-way valve 407, and a circulation valve 415 and a circulation pump 414 are disposed in the ink flow channel 450. A supplement liquid 416 is filled in a supplement liquid container 420, and is connected to respective components, namely, a supplement liquid pump 417, a cleaning valve 418, and a supplement liquid inlet port of the three-way valve 407.

As shown in FIG. 22, in the nozzle body 408*a*, vibration sources 423 and power supply terminals 422 are interposed between vibration source mounting axis 424*a* and a vibration source securing nut 421*a*, and an orifice 426 is mounted with screws to a leading edge of the nozzle body 408*a*. Ink flow channels 428 and 429 are respectively provided on the center of the vibration source mounting axis 424*a* and the center of the orifice 426.

The bore of the vibration source securing nut 421*a* has a stepped shape, in which a smaller portion is provided with screw threads, and a larger portion has a clearance 427 between the bore and the vibration source mounting axis 424*a*. Further, the outer profile of the vibration source securing nut 421*a* is a stepped shape, and a part of the stepped portion is formed as a groove portion 421*b*.

The operation of the above-described configuration will be described below.

When the ink side of the three-way valve 407 is opened, the ink 402*a* in the ink main container 401 is pumped by the supply pump 404 to travel through the ink supply pipeline 409, and is then filtered by the main filter 405 for removal of impurities. The ink 402*a* is regulated by the pressure regulating valve 406 to adjust the pressure, and is then supplied to the nozzle body 408*a*. The ink 402*a* thus supplied is formed by the vibration of the vibration sources 423 located in the nozzle body 408*a* into a liquid column with a body and nodes. The ink 402*a* is next ejected from the leading edge of the orifice 426, and is then formed into ink droplets 410 according to the surface tension of the ink 402*a*. The ink droplets 410 are electrically charged by a charging electrode (not shown) with a charge amount corresponding to character information, and are deflected by deflecting electrodes (not shown). Printing is then performed on a printing material (not shown). In this case, ink droplets 410 unused for printing, are directed into the gutter 411, and then are collected by the collection pump 412 into the ink main container 401.

According to a mechanical vibration frequency characteristic 432 of a diaphragm portion 424*b* of a conventional nozzle body 408*b* shown in FIG. 23, a resonance point f0 is apart greater than a practical power supply frequency fa. In addition, a vibration amplitude Y0 of the diaphragm portion 424*b* is small, and the body and nodes are formed in the liquid column, so that the amount of energy is small, and hence the ink is less likely to be formed into the ink droplets 410. In order for the ink to be easily formed into the ink droplets 410, the resonance point f0 has to be lowered to be closer to the practical power supply frequency fa. To achieve this, the outside diameter and overall length of a vibration source securing nut 441 have to be increased. This situation creates the problem that the nozzle body 408 has to be enlarged.

According to the present embodiment, the vibration source securing nut 421*a* is not enlarged, but is formed with the bore having the stepped shape, in which the smaller portion is provided with screw threads, and the larger portion has the clearance 427 between the bore and the vibration source mounting axis 424*a*. In addition, the outer profile of the vibration source securing nut 421*a* is made into the stepped shape, and a part of the stepped portion is formed as the groove portion 421*b*. Accordingly, as shown in FIG. 25, a resonance point f1 in a mechanical vibration frequency characteristic 431 of the diaphragm portion 424*b* of the nozzle body 408 is relatively close to the practical power supply frequency fa. Further, a vibration amplitude Y1 of the diaphragm portion 424*b* is increased, and also the amount of energy for forming the body and nodes in the liquid column of the ink is increased, so that the ink is easily to be formed into the ink droplets 410.

Among the benefits achieved by configuring the vibration source securing nut 421*a* into the shape described above are the benefit of being able to have a nozzle body 408 that can be miniaturized, and a power supply voltage that can be reduced.

FIG. 26 is a cross sectional view showing a nozzle body 408*c* that is a modified example of the nozzle body 408*a*. In the nozzle body 408*c*, a vibration source securing nut 442 is formed with the bore having the stepped shape, in which the smaller portion is provided with screw threads, and the larger portion has the clearance 427 between the bore and the vibration source mounting axis 424*a*. However, the outer profile of the vibration source securing nut 442 is not made into the stepped shape.

FIG. 27 is a cross sectional view showing a nozzle body 408*d* that is a modified example of the nozzle body 408*a*. In the nozzle body 408*d*, a vibration source securing nut 443 is formed with the bore having the stepped shape, in which the smaller portion is provided with screw threads, and the larger portion has the clearance 427 between the bore and the vibration source mounting axis 424*a*. While the outer profile of the vibration source securing nut 443 is made into the stepped shape, a part of the stepped portion is not formed into the groove portion 421*b*.

Even in each of the modified examples shown in FIGS. 26 and 27, while the vibration source securing nut 421*a* is not enlarged, the resonance point f1 in the mechanical vibration frequency characteristic 432 of the diaphragm portion 424*b* of the nozzle body 408 is relatively close to the practical power supply frequency fa. Further, the vibration amplitude Y0 of the diaphragm portion 424*b* is increased, and also the amount of energy for forming the body and nodes in the liquid column of the ink is increased, so that the ink is easily formed into the ink droplets 410.

While the present invention has been described in connection with preferred embodiments thereof, it will be understood that it is not intended to limit the invention to those embodiments. On the contrary, it is intended to cover all alternatives, modifications, and equivalents as may be included within the spirit and scope of the invention as defined by the appended claims.

What is claimed is:

1. An inkjet recording apparatus comprising:

a main body including a pump that pressurizes or draws a liquid(s), such as an ink;

a print head including:

a nozzle that atomizes ink that is pressure-fed from the main body into ink droplets, a charging electrode that electrically charges the ink droplets, a deflecting electrode that forms an electric field that deflects the charged ink droplets, and a gutter that collects ink that was not used for printing, wherein the nozzle includes a surface-treated layer that repels the ink to a portion of the nozzle where the liquid is supplied.

2. An inkjet recording apparatus as claimed in claim 1, wherein the nozzle further includes:

an ink chamber that imparts vibrations to the ink;

an ink flow channel that communicates with the ink chamber and that supplies therethrough the ink into the ink chamber; and an ink flow channel that communicates with the ink chamber and that includes an ejection port that ejects the ink, wherein the surface-treated layer is provided on inner walls of the ink flow channels and the ink chamber.

3. An inkjet recording apparatus as claimed in claim 1, wherein the nozzle further includes:

an ink chamber that imparts vibrations to the ink;

an ink flow channel that communicates with the ink chamber and that supplies therethrough the ink into the ink chamber; and an ink flow channel that communicates with the ink chamber and that includes an ejection port that ejects the ink, wherein the surface-treated layer is provided on at least an inner wall of the ink chamber.

4. An inkjet recording apparatus comprising:

a main body that supplies an ink; and a print head including a nozzle that ejects the ink transferred from the main body through a pipeline, the nozzle including:

an ejection port that ejects the ink, a liquid chamber including an inflow port allowing the ink to flow thereinto and an outflow port communicating with the ejection port, a liquid supply flow channel that guides the ink into the liquid chamber by connecting between the pipeline through which the ink is transferred from the main body and the inflow port, an exciting wall that is provided in a part of the liquid chamber and that vibrates the ink present in the liquid chamber, and an exciting portion that vibrates the exciting wall, wherein the inflow port of the liquid chamber is provided in the exciting wall.

5. An inkjet recording apparatus as claimed in claim 4, wherein a flow channel length of the liquid supply flow channel of the nozzle has a length that does not cause a liquid resonance.

6. An inkjet recording apparatus as claimed in claim 4, wherein the liquid supply flow channel is provided in an interior of the exciting portion, and the exciting wall and the exciting portion are connected together by the liquid supply flow channel.

7. An inkjet recording apparatus as claimed in claim 4, wherein the liquid supply flow channel is provided in an interior of the exciting portion, and the exciting wall and the exciting portion are connected together by the liquid supply flow channel, wherein a neck-shaped portion is provided between the exciting wall and the exciting portion, and the liquid supply flow channel is provided in an interior of the neck-shaped portion.

8. An inkjet recording apparatus comprising:

a nozzle that vibrates and ejects an ink supplied from an ink container provided in an interior of a main body;

a charging electrode that electrically charges ink droplets ejected from the nozzle;

a deflecting electrode that forms an electric field that deflects the charged ink droplets; and a housing that includes a structure that holds the nozzle by using an elastic member, and a joint portion that connects to an ink supply flow channel that guides the ink supplied from the ink container to flow therethrough, wherein the nozzle and the joint portion are not in contact with one another.

9. An inkjet recording apparatus as claimed in claim 8, wherein the nozzle includes:

an ink flow channel that guides the ink supplied from the ink container to flow therethrough;

an exciting source provided on a circumference of the ink flow channel; and a nozzle head portion including a liquid chamber that is connected to the ink flow channel and that is filled with the ink passed through the ink flow channel.

10. An inkjet recording apparatus as claimed in claim 8, wherein:

the nozzle includes an ink flow channel that guides the ink supplied from the ink container to flow therethrough, an exciting source provided on a circumference of the ink flow channel, and a nozzle head portion including a liquid chamber that is connected to the ink flow channel and that is filled with the ink passed through the ink flow channel; and the elastic member is disposed on an outer circumference of the nozzle head portion and in an end portion of an exciting portion including the exciting source.

11. An inkjet recording apparatus as claimed in claim 8, wherein:

the nozzle includes an ink flow channel that guides the ink supplied from the ink container to flow therethrough, an exciting source provided on a circumference of the ink flow channel, and a nozzle head portion including a liquid chamber that is connected to the ink flow channel and that is filled with the ink passed through the ink flow channel; and the housing includes a nozzle direction adjusting member that is provided on an outer side of an end portion of the ink flow channel including an opening portion that admits the ink, and that movably holds the end portion of the ink flow channel via an elastic member.

12. An inkjet recording apparatus as claimed in claim 8, wherein:

the nozzle includes an ink flow channel that guides the ink supplied from the ink container to flow therethrough, an exciting source provided on a circumference of the ink flow channel, and a nozzle head portion including a liquid chamber that is connected to the ink flow channel and that is filled with the ink passed through the ink flow channel; and the housing includes a nozzle direction adjusting member that is provided on an outer side of an end portion of the ink flow channel including an opening portion that admits the ink, and that movably holds the end portion of the ink flow channel via an elastic member, wherein the nozzle direction adjusting member includes a position adjusting screw that determines a position of the end portion of the ink flow channel, and a position adjusting elastic member that exerts a force on the ink flow channel from a direction opposite the position adjusting screw.

13. An inkjet recording apparatus as claimed in claim 8, wherein:

the nozzle includes an ink flow channel that guides the ink supplied from the ink container to flow therethrough, an exciting source provided on a circumference of the ink flow channel, and a nozzle head portion including a liquid chamber that is connected to the ink flow channel and that is filled with the ink passed through the ink flow channel;

the housing includes therein a nozzle direction adjusting member that is provided on an outer side of an end portion of the ink flow channel including an opening portion that admits the ink, and that movably holds the end portion of the ink flow channel via an elastic member; and a portion on an ink supply side of the housing includes a joint portion that is in contact with the nozzle direction adjusting member via a seal member and that connects to an ink supply flow channel that supplies ink from the main body.

14. An inkjet recording apparatus as claimed in claim 8, wherein:

the nozzle includes an ink flow channel that guides the ink supplied from the ink container to flow therethrough, an exciting source provided on a circumference of the ink flow channel, and a nozzle head portion including a liquid chamber that is connected to the ink flow channel and that is filled with the ink passed through the ink flow channel;

the housing includes therein a nozzle direction adjusting member that is provided on an outer side of an end portion of the ink flow channel including an opening portion that admits the ink, and that movably holds the end portion of the ink flow channel via an elastic member, wherein the nozzle direction adjusting member includes a position adjusting screw that determines a position of the end portion of the ink flow channel, and a position adjusting elastic member that exerts a force on the ink flow channel from a direction opposite the position adjusting screw; and wherein the nozzle direction adjusting member includes a plurality of assemblies each including the position adjusting screw and the position adjusting elastic member and enables a nozzle to be adjusted in plural directions.

15. An inkjet recording apparatus that forms a character by using a charging electrode that electrically charges ink droplets ejected from a nozzle with a character signal and a deflecting electrode that deflects the charged ink droplets, and that collects and reuses ink droplets unused for forming the character, wherein:

the nozzle includes a vibration source mounting axis and a nut that secures a cylindrical vibration source fitted about the vibration source mounting axis, wherein a bore of the nut is formed into a stepped shape, and a clearance is provided between the vibration source mounting axis and a part of the bore of the nut.

16. An inkjet recording apparatus as claimed in claim 15, wherein an outer profile of the nut is made into a stepped shape.

17. An inkjet recording apparatus as claimed in claim 15, wherein a part of an outer profile of the nut has the shape of a groove.

* * * * *